US011716561B2

(12) United States Patent
Li et al.

(10) Patent No.: US 11,716,561 B2
(45) Date of Patent: Aug. 1, 2023

(54) SPEAKER DEVICE

(71) Applicant: SHENZHEN SHOKZ CO., LTD., Guangdong (CN)

(72) Inventors: Chaowu Li, Shenzhen (CN); Zhuyang Jiang, Shenzhen (CN); Fen You, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 173 days.

(21) Appl. No.: 17/305,246

(22) Filed: Jul. 1, 2021

(65) Prior Publication Data

US 2021/0329366 A1 Oct. 21, 2021

Related U.S. Application Data

(63) Continuation of application No. PCT/CN2019/102376, filed on Aug. 24, 2019.

(30) Foreign Application Priority Data

Jan. 5, 2019 (CN) ..... 201910009887.3

(51) Int. Cl.
*H04R 25/00* (2006.01)
*H04R 1/10* (2006.01)
(Continued)

(52) U.S. Cl.
CPC ..... *H04R 1/1041* (2013.01); *H04R 1/026* (2013.01); *H04R 1/10* (2013.01); *H04R 1/105* (2013.01);
(Continued)

(58) Field of Classification Search
CPC ..... H04R 1/1041; H04R 1/105; H04R 1/46; H04R 2460/13; H04R 1/1091; H04R 25/456
See application file for complete search history.

(56) References Cited

U.S. PATENT DOCUMENTS 5,784,470 A 7/1998 Fackler et al.
2009/0185699 A1* 7/2009 Kim ..... H04R 1/1066 381/151
(Continued)

FOREIGN PATENT DOCUMENTS

CN 204289156 U 4/2015
CN 109061901 A 12/2018

OTHER PUBLICATIONS

International Search Report in PCT/CN2019/102376 dated Oct. 30, 2019, 6 pages.
(Continued)

*Primary Examiner* — Amir H Etesam
(74) *Attorney, Agent, or Firm* — Metis IP LLC

(57) ABSTRACT

A speaker device is provided, including a circuit housing for accommodating a control circuit or a battery, an ear hook connected to the circuit housing, a core housing for accommodating an earphone core, a button, and an elastic pad. The control circuit or the battery may drive the earphone core to vibrate to generate sound. The core housing may be connected to the ear hook through a hinge component, which may rotate to change a location of the core housing relative to the ear hook, thereby making the core housing attach to a front or back of a user's ear. The button may be disposed at a button hole on the circuit housing and move relative to the button hole to generate a control signal for the control circuit. The elastic pad may be disposed between the button and the button hole and hinder a movement therebetween.

19 Claims, 14 Drawing Sheets

(51) Int. Cl.
*H04R 1/02* (2006.01)
*H04R 1/28* (2006.01)

(52) U.S. Cl.
CPC ..... *H04R 1/1008* (2013.01); *H04R 1/1066* (2013.01); *H04R 1/1075* (2013.01); *H04R 1/1091* (2013.01); *H04R 1/28* (2013.01); *H04R 2460/13* (2013.01)

(56) References Cited

U.S. PATENT DOCUMENTS

| | | | |
|---|---|---|---|
| 2016/0337766 | A1 | 11/2016 | Flaig |
| 2021/0067879 | A1 | 3/2021 | Li et al. |

OTHER PUBLICATIONS

Written Opinion in PCT/CN2019/102376 dated Oct. 30, 2019, 10 pages.

* cited by examiner

SPEAKER DEVICE

CROSS REFERENCE TO RELATED APPLICATIONS

This application is a Continuation of International Patent Application No. PCT/CN2019/102376, filed on Aug. 24, 2019, which claims priority of Chinese Patent Application No. 201910009887.3, filed on Jan. 5, 2019, the entire contents of each of which are incorporated herein by reference.

TECHNICAL FIELD

The present disclosure relates to a speaker device, and in particular, to a speaker device with waterproof function.

BACKGROUND

In general, people can hear the sound because the air transmits vibration to the eardrum through the external ear canal, and the vibration formed by the eardrum drives the human auditory nerve, and people can perceive the vibration of the sound. At present, earphones are widely used in people's lives. For example, users can use earphones to play music, answer calls, etc. Earphones have become an important item in people's daily life. Generally, earphones in the market may not satisfy user's requirement on some occasions. For example, a user may need to control an earphone when the user is swimming, or when the user is outdoor on rainy days, etc. Earphones with waterproof function and good sound quality are more popular. Therefore, it is desirable to provide a speaker device with a waterproof function.

SUMMARY

The embodiments of the present disclosure provide a speaker device including a circuit housing, an ear hook, a core housing, a button, and an elastic pad. The circuit housing may be configured to accommodate a control circuit or a battery. One end of the ear hook may be connected to the circuit housing. The core housing may be configured to accommodate an earphone core, the control circuit or the battery driving the earphone core to vibrate to generate sound. The core housing may be connected to an end of the ear hook far from the circuit housing through a hinge component. The hinge component may be able to rotate to change a location of the core housing relative to the ear hook, so as to make the core housing attach to a front or a back of a user's ear. The button may be disposed at a button hole on the circuit housing. The button may move relative to the button hole to generate a control signal for the control circuit. The elastic pad may be disposed between the button and the button hole and may hinder a movement of the button toward the button hole.

In some embodiments, the circuit housing may include a main sidewall and an auxiliary sidewall connected to the main sidewall. A first recessed area may be disposed on the auxiliary sidewall. The elastic pad may be disposed in the first recessed area. The elastic pad may include a second recessed area corresponding to the button hole. The second recessed area may extend to an inside of the button hole.

In some embodiments, the button may include a button body and a button contact. The button contact may extend into the second recessed area. The button body may be disposed on a side of the button contact away from the elastic pad.

In some embodiments, the circuit housing may accommodate a button circuit board. A button switch corresponding to the button hole may be disposed on the button circuit board. The button contact may be configured to contact with and trigger the button switch when a user presses the button.

In some embodiments, the button may include at least two button units disposed apart from each other and a connection part configured to connect the at least two button units. The elastic pad may include an elastic convex configured to support the connection part.

In some embodiments, the speaker device may include a rigid pad. The rigid pad may be disposed between the elastic pad and the circuit housing. The rigid pad may include a through hole through which the second recessed area passes.

In some embodiments, the elastic pad and the rigid pad may be fixed against each other.

In some embodiments, the ear hook may be plugged and fixed to the circuit housing. A housing sheath may be moulded on the ear hook. The housing sheath may be wrapped around a periphery of the circuit housing and a periphery of the button in a sleeved manner.

In some embodiments, the housing sheath may include a bag-like structure with an open end. The circuit housing and the button may enter into the housing sheath through the open end of the housing sheath.

In some embodiments, the open end of the housing sheath may include an annular flange protruding inwardly. An end of the circuit housing away from the ear hook may have a stepped structure to form an annular table. The annular flange may abut on the annular table when the housing sheath covers the periphery of the circuit housing.

In some embodiments, a sealant may be applied to a joint area between the annular flange and the annular table to connect the housing sheath and the circuit housing in a sealed manner.

In some embodiments, the speaker device may include an auxiliary film. The auxiliary film may include a board and a pressing foot protruding with respect to the board. The pressing foot may be configured to press the button circuit board on an inner surface of the auxiliary sidewall.

In some embodiments, at least one mounting hole may be disposed on the circuit housing. The speaker device may further include at least one conductive post each of which is inserted into one mounting hole of the at least one mounting hole. A hollow region may be disposed on the board. The board may be disposed on an inner surface of the circuit housing. The at least one mounting hole may be disposed inside the hollow region to form a glue tank on a periphery of the at least one conductive post.

In some embodiments, the hollow region may include a notch. A striped convex rib corresponding to the notch may be integrally formed on an inner surface of the main sidewall. The striped convex rib may cooperate with the auxiliary film to make the glue tank closed.

In some embodiments, the hinge component may include a hinge, a rod-like component, and a fixing component. The hinge may include a hinge base and a hinge arm. The hinge arm and the hinge base may be rotatably connected by a rotating axis. The hinge arm may rotate relative to the hinge base under an external force, so to alter a position of the core housing relative to the ear hook.

In some embodiments, the core housing may include a main housing and a partition assembly. The partition assembly may be located inside the main housing and may be connected to the main housing. The partition assembly may separate an inner space of the main housing into a first housing space and a second housing space. The core housing may be also provided with a plug hole that is connected to an outer end surface of the core housing.

In some embodiments, the second housing space may be disposed close to the plug hole.

In some embodiments, the main housing may include a peripheral sidewall and a bottom wall connected to one end surface of the peripheral sidewall.

In some embodiments, the partition assembly may include a side partition two ends of which are connected to the peripheral sidewall, and a bottom partition which is disposed apart from the side partition and connected to the peripheral sidewall and the side partition, respectively. A wiring hole may be provided on the bottom partition. A wiring trough may be provided on a top edge of the side partition far away from the bottom wall.

In some embodiments, the circuit housing may include a housing body which is provided with a cavity having at least one opening, and a cover which is disposed on the opening for sealing the cavity. The cover may include a rigid support and a soft cover layer that is injection-moulded integrally on a surface of the support. The support may be used to physically connect the housing body, and the cover layer may be used to seal the cavity after the support is connected to the housing body.

In some embodiments, a shape of a side of the support facing toward the housing body may match the opening so as to snap onto the opening, and the cover layer may cover an outer surface of the support away from the housing body.

In some embodiments, the support may include an insertion part and a cover part. The cover part may be covered on the opening. The insertion part may be disposed on one side of the cover part and extends into the cavity along an inner wall of the cavity to fix the cover part on the opening.

In some embodiments, the housing body may include an opening edge for defining the opening. The cover part may be pressed against an inner region of the opening edge near the opening. The cover layer may cover an outer surface of the cover part away from the housing body, and be pressed on an outer region outside the inner region of the opening edge, thereby achieving a seal between the cover layer and the opening edge.

In some embodiments, in a snapped state, a contact end surface between the cover part and the opening edge may be flush with a contact end surface between the cover layer and the opening edge, or the cover layer may further extend between the cover part and the opening edge, and be pressed on the inner region of the opening edge by the cover part.

In some embodiments, a cavity of the housing body may include a circuit component. The circuit component may include a switch. The support may include a switch hole corresponding to the switch. The cover layer may cover the switch hole and include a pressing part at a position corresponding to the switch hole. The pressing part may extend toward the inside of the cavity through the switch hole. When a corresponding position of the cover layer is pressed, the pressing part may press the switch on the circuit component, thereby triggering the circuit component to perform a preset function.

BRIEF DESCRIPTION OF THE DRAWINGS

The present disclosure is further illustrated in terms of exemplary embodiments. These exemplary embodiments are described in detail with reference to the drawings. These embodiments are non-limiting exemplary embodiments, in which like reference numerals represent similar structures, and wherein.

DETAILED DESCRIPTION

Figure 1:
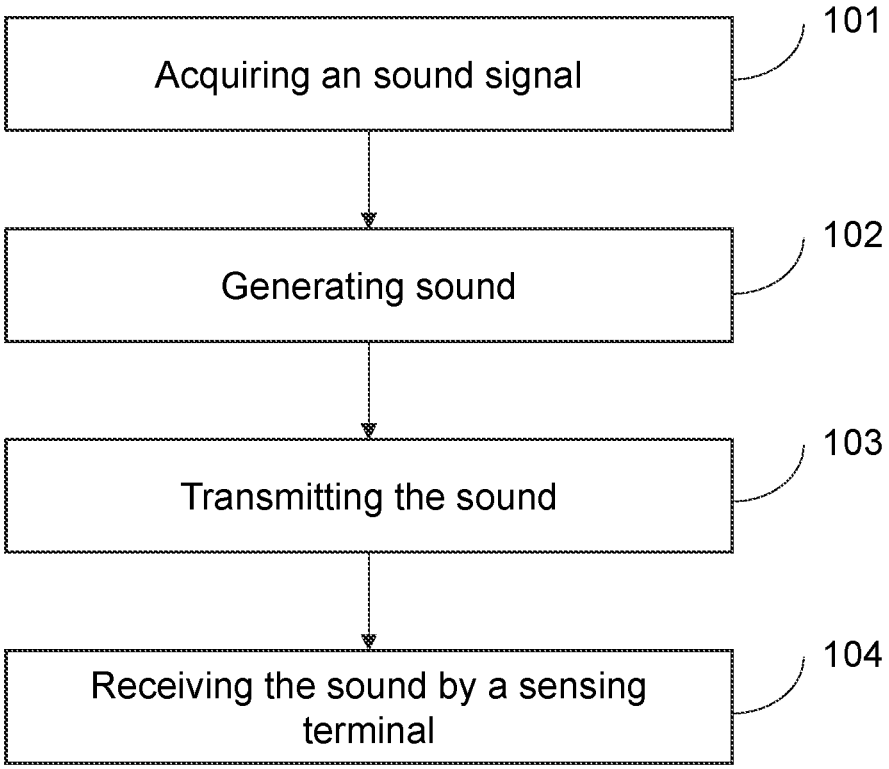
FIG. 1 is a flowchart illustrating an exemplary process for generating auditory sense through a speaker device according to some embodiments of the present disclosure.

In order to illustrate the technical solutions related to the embodiments of the present disclosure, brief introduction of the drawings referred to in the description of the embodiments is provided below. Obviously, drawings described below are only some examples or embodiments of the present disclosure. Those skilled in the art, without further creative efforts, may apply the present disclosure to other similar scenarios according to these drawings. It should be understood that the exemplary embodiments are provided merely for better comprehension and application of the present disclosure by those skilled in the art, and not intended to limit the scope of the present disclosure. Unless obviously obtained from the context or the context illustrates otherwise, the same numeral in the drawings refers to the same structure or operation.

As used in the disclosure and the appended claims, the singular forms "a," "an," and "the" include plural referents unless the content clearly dictates otherwise. In general, the terms "comprise," "comprises," and/or "comprising," "include," "includes," and/or "including," merely prompt to include steps and elements that have been clearly identified, and these steps and elements do not constitute an exclusive listing. The methods or devices may also include other steps or elements. The term "based on" is "based at least in part on." The term "one embodiment" means "at least one embodiment", and the term "another embodiment" means "at least one additional embodiment". Related definitions of other terms will be given in the description below. Hereinafter, "player", "speaker device", "speaking device" or "speaker" will be used in describing the sound conduction related techniques in the present invention. This description is only a form of speaker application. For those skilled in the art, "speaker device", "speaker", or "earphone" can also be replaced by other similar words, such as "player", "hearing aid", or the like. In fact, the various implementations in the present disclosure may be easily applied to other non-speaker-type hearing devices. For example, for those skilled in the art, after understanding the basic principle of the speaker device, various modifications, and changes to the implementation of the speaker device may be performed on the specific methods and details of the speaker device without departing from this principle. In particular, the environment sound picking and processing function may be added to the speaker device, so that the speaker device has the function of the hearing aid. For example, in the case of using a bone conduction speaker device, a sound transmitter such as a microphone may pick up an ambient sound close to the user/wearer. The sound may be further processed using a certain algorithm, and the processed sound (or a generated electrical signal) may be transmitted to the user/wearer. That is, the speaker device may be modified and have the function of picking up ambient sound. The ambient sound may be processed and transmitted to the user/wearer through the speaker device, thereby implementing the function of a hearing aid. The algorithm mentioned above may include a noise cancellation algorithm, an automatic gain control algorithm, an acoustic feedback suppression algorithm, a wide dynamic range compression algorithm, an active environment recognition algorithm, an active noise reduction algorithm, a directional processing algorithm, a tinnitus processing algorithm, a multi-channel wide dynamic range compression algorithm, an active howling suppression algorithm, a volume control algorithm, or the like, or any combination thereof.

FIG. 1 is a flowchart illustrating an exemplary process for generating auditory sense through a speaker device according to some embodiments of the present disclosure. The speaker device may transfer sound to an auditory system through bone conduction or air conduction, thereby generating an auditory sense. As shown in FIG. 1, the process for generating the auditory sense through the speaker device may include the following operations.

In 101, the speaker device may acquire or generate a signal (also referred to as a "sound signal") containing sound information. In some embodiments, the sound information may refer to a video file or an audio file with a specific data format, or data or files that may be converted to a sound through specific approaches. In some embodiments, the signal containing the sound information may be obtained from a storage unit of the speaker device itself. In some embodiments, the signal containing the sound information may be obtained from an information generation system, a storage system, or a transmission system other than the speaker device. The signal containing the sound information may include an electrical signal, and/or other forms of signals other than the electrical signal, such as an optical signal, a magnetic signal, and a mechanical signal, or the like. In principle, as long as the signal includes information that may be used to generate sounds by a speaker device, the signal may be processed as the sound signal. In some embodiments, the sound signal may come from a signal source, or a plurality of signal sources. The plurality of signal sources may be independent of or dependent on each other. In some embodiments, manners of generating or transmitting the sound signal may be wired or wireless and may be real-time or time-delayed. For example, the speaker device may receive an electrical signal containing sound information via a wired or wireless connection or may obtain data directly from a storage medium and generate a sound signal. Taking bone conduction technology as an example, components with a sound collection functions may be added to a bone conduction speaker device. The bone conduction speaker device may pick up sound from ambient environment and convert mechanical vibration of the sound into an electrical signal. Further, the electrical signal may be processed through an amplifier to meet specific requirements. The wired connection may be realized by using, including but not limited to a metal cable, an optical cable, or a hybrid cable of metal and optical, such as a coaxial cable, a communication cable, a flexible cable, a spiral cable, a non-metal sheathed cable, a metal sheathed cable, a multi-core cable, a twisted pair cable, a ribbon cable, a shielded cable, a telecommunication cable, a double-stranded cable, a parallel twin-core wire, a twisted-pair wire. The wired connection may also be realized by using other types of transmission carriers, such as transmission carriers for electrical or optical signals.

The storage device or storage unit mentioned herein may include a storage device or storage unit on a direct attached storage, a network attached storage, a storage area network, and/or other storage systems. The storage device may include but is not limited to common types of storage devices such as a solid-state storage device (a solid-state drive, a solid-state hybrid hard drive, etc.), a mechanical hard drive, a USB flash drive, a memory stick, a storage card (e.g., CF, SD, etc.), and other drives (e.g., CD, DVD, HD DVD, Blu-ray, etc.), a random access memory (RAM), a read-only memory (ROM), etc. The RAM may include but is not limited to a decimal counter, a selection tube, a delay line memory, a Williams tube, a dynamic random access memory (DRAM), a static random access memory (SRAM), a thyristor random access memory (T-RAM), a zero capacitive random access memory (Z-RAM), etc. The ROM may include but is not limited to a magnetic bubble memory, a magnetic button line memory, a thin film memory, a magnetic plating line memory, a magnetic core memory, a drum memory, an optical disk driver, a hard disk, a magnetic tape, an early non-volatile memory (NVRAM), a phase change memory, a magneto-resistive random access memory, a ferroelectric random access memory, a non-volatile SRAM, a flash memory, an electronically erasable rewritable read-only memory, an erasable programmable read-only memory, a programmable read-only memory, a shielded heap read memory, a floating connection gate random access memory, a nano random access memory, a racetrack memory, a variable resistance memory, a programmable metallization unit, etc. The storage device/storage unit mentioned above is only used for illustration purposes. The storage medium used in the storage device/unit is not limited.

In 102, the speaker device may convert the signal containing the sound information into vibration to generate the sound. The speaker device may use a specific transducer to convert the signal into a mechanical vibration, and the generation of the mechanical vibration may accompany with energy conversion. The energy conversion process may include coexistence and conversion of multiple types of energy. For example, the electrical signal may be directly converted into the mechanical vibration by the transducers, and generate the sound. As another example, the sound information may be included in an optical signal, which may be converted into mechanical vibrations by a specific transducer. Other types of energy that may be coexisting and converted when the transducer works may include thermal energy, magnetic field energy, etc. In some embodiments, an energy conversion type of the transducer may include but is not limited to, a moving coil type, an electrostatic type, a piezoelectric type, a moving iron type, a pneumatic type, an electromagnetic type, or the like, or any combination thereof. A frequency response range and sound quality of the speaker device may be affected by the energy conversion type and a property of each physical component of the transducer. For example, in a transducer with the moving coil type, a wound cylindrical coil may be connected to a vibration plate, the coil driven by a signal current may drive the vibration plate to vibrate in a magnetic field and generate the sound. Factors, such as material expansion and contraction, folds deformation, a size, a shape, and a fixation manner of the vibration plate, a magnetic density of a permanent magnet, etc., may have a relatively great effect on the sound quality of the speaker device.

The term "sound quality" used herein may indicate the quality of the sound, which may refer to an audio fidelity after the sound is processed, transmitted, or the like. In an audio device, the sound quality may include audio intensity and magnitude, an audio frequency, an audio overtone, or harmonic components, etc. For an audio device, the sound quality may include audio intensity and magnitude, an audio frequency, an audio overtone, a harmonic component, or the like, or any combination thereof. When the sound quality is evaluated, a measuring manner and an evaluation criterion for objectively evaluating the sound quality may be used, other manners that combine different elements of the sound and subjective feelings for evaluating various properties of the sound quality may also be used.

In 103, the sound is transmitted by a transmission system. In some embodiments, a transmission system refers to a substance that can deliver a vibration signal containing sound information, such as the skull, the bony labyrinth, the inner ear lymph, the spiral organ of a human or/and an animal with the auditory system. As another example, the transmission system also refers to a medium (e.g., air and liquid) that may transmit a sound. To illustrate the process of transmitting sound information by the transmission system, a bone conduction speaker device may be taken as an example. The bone conduction speaker device may directly transmit a sound wave (e.g., a vibration signal) converted from an electrical signal to an auditory center through bones. In addition, the sound wave may be transmitted to the auditory center through air conduction. More descriptions regarding the air conduction may be found elsewhere in the present disclosure.

In 104, the sound information may be transmitted to a sensing terminal. Specifically, the sound information may be transmitted to the sensing terminal through the transmission system. In some embodiments, the speaker device may pick up or generate a signal containing the sound information, convert the sound information into a sound vibration by the transducer. The speaker device may transmit the sound to the sensing terminal through the transmission system, and a user may hear the sound. Generally, a subject of the sensing terminal, the auditory system, the sensory organ, etc. described above may be a human or an animal with the auditory system. It should be noted that the following description of the speaker device used by a human does not constitute a restriction on the application scene of the speaker device, and similar descriptions may also be applied to other animals.

The above description of the process of the speaker device is only a specific example and should be not regarded as the only feasible implementation. Obviously, for those skilled in the art, after understanding the basic principle of the speaker device, it may be possible to make various modifications and changes in forms and details of the specific methods and operations of implementing the speaker device without departing from the principles, but these modifications and changes are still within the scope of the present disclosure.

Figure 2:
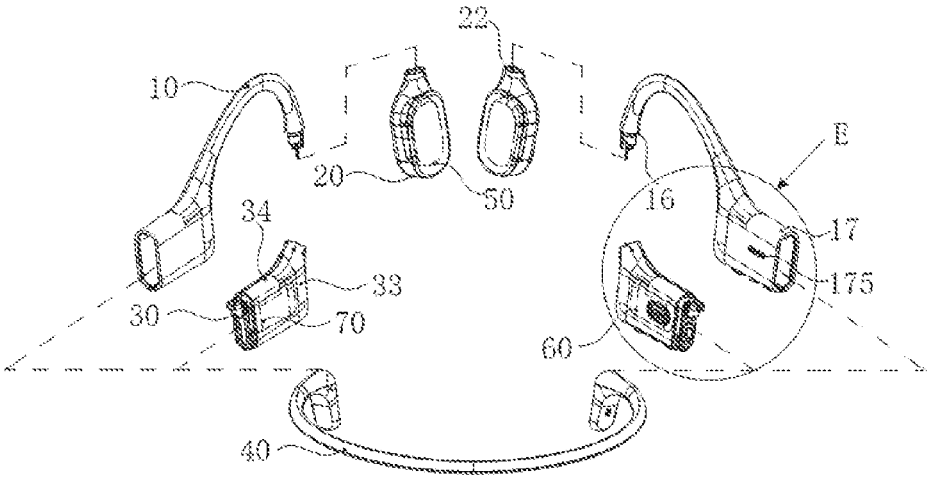
FIG. 2 is a schematic diagram illustrating an exploded structure of an exemplary MP3 player according to some embodiments of the present disclosure.

The speaker device described according to some embodiments of the present disclosure may include, but is not limited to, an earphone, an MP3 player, a hearing aid, or other devices with speaker function. In the following specific embodiments of the present disclosure, an MP3 player is taken as an example to describe the speaker device in detail. FIG. 2 is a schematic diagram illustrating an exploded structure of an exemplary MP3 player according to some embodiments of the present disclosure. As shown in FIG. 2, in some embodiments, an MP3 player may include an ear hook 10, a core housing 20, a circuit housing 30, a rear hook 40, an earphone core 50, a control circuit 60, and a battery 70. The core housing 20 and the circuit housing 30 may be disposed at two ends of the ear hook 10 respectively, and the rear hook 40 may be further disposed at an end of the circuit housing 30 away from the ear hook 10. The number (or the count) of the core housings 20 may be two. The two core housings 20 may be configured to accommodate two earphone cores 50, respectively. The number (or the count) of the circuit housings 30 may be two. The two circuit housings 30 may be configured to accommodate the control circuit 60 and the battery 70, respectively. In some embodiments, the control circuit 60 may be configured to cause the earphone core 50 to vibrate to generate a sound. For example, the control circuit 60 may cause the earphone core 50 to vibrate based on a control signal which may be generated when a user presses a button of the MP3 player.

Figure 3:
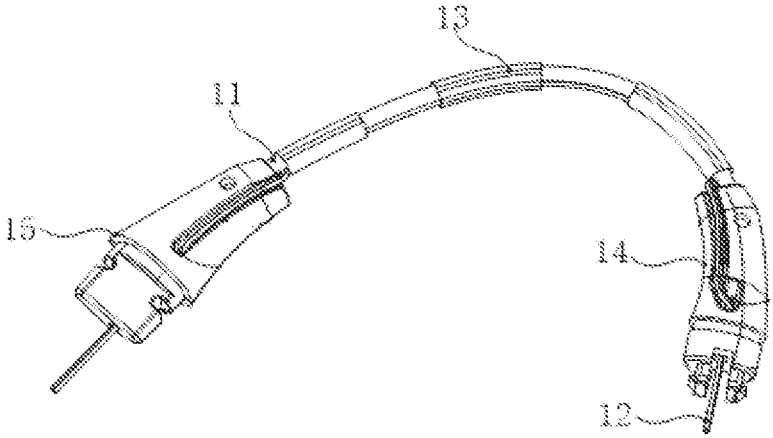
FIG. 3 is a schematic diagram illustrating a part of a structure of an ear hook of an MP3 player according to some embodiments of the present the present disclosure.
Figure 4:
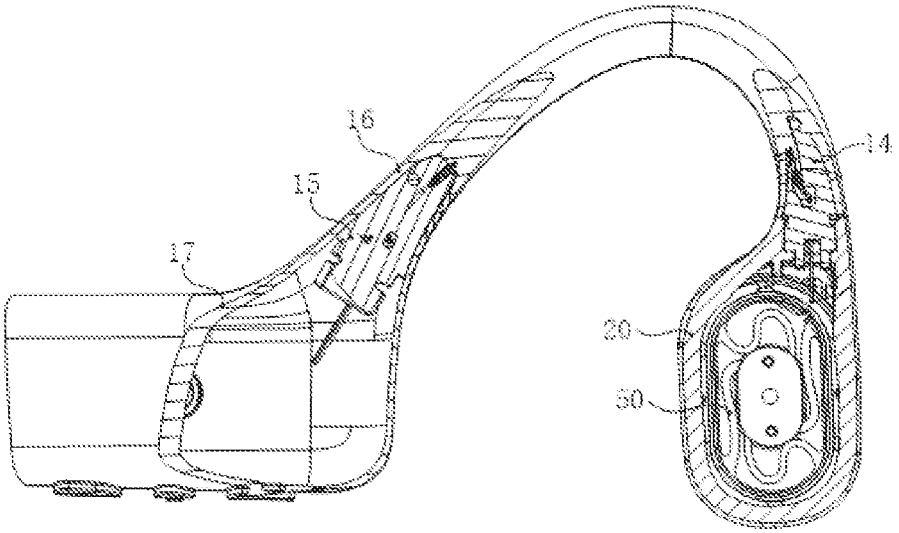
FIG. 4 is a partial sectional view of an MP3 player according to some embodiments of the present disclosure.

FIG. 3 is a schematic diagram illustrating a part of a structure of an ear hook of an MP3 player according to some embodiments of the present the present disclosure. FIG. 4 is a partial sectional view of an MP3 player according to some embodiments of the present disclosure. Referring to FIG. 2, FIG. 3, and FIG. 4, in some embodiments, the ear hook 10 may include an elastic metal wire 11, a wire 12, a fixing sleeve 13, a first plug end 14, and a second plug end 15. The first plug end 14 and the second plug end 15 may be disposed at both ends of the elastic metal wire 11. In some embodiments, the ear hook 10 may further include a protective sleeve 16 and a housing sheath 17 integrally formed with the protective sleeve 16. In some embodiments, the protective sleeve 16 may be injection moulded around periphery of the elastic metal wire 11, the wire 12, the fixing sleeve 13, the first plug end 14, and the second plug end 15. Thus, the protective sleeve 16 may be fixedly connected with the elastic metal wire 11, the wire 12, the fixing sleeve 13, the first plug end 14, and the second plug end 15 respectively. There is no need to form the protective sleeve 16 separately by injection moulding and then further wrap protective sleeve 16 around the periphery of the elastic metal wire 11, the first plug end 14, and the second plug end 15, thereby simplifying the manufacturing and assembly processes and improving the reliability and stability of the fixation of the protective sleeve 16.

In some embodiments, when the protective sleeve 16 is being formed, a housing sheath 17 disposed on a side close to the second plug end 15 may be integrally formed with the protective sleeve 16. In some embodiments, the housing sheath 17 may be integrally formed with the protective sleeve 16 to form a whole structure. The circuit housing 30 may be connected to one end of the ear hook 10 by being plugged and fixed to the second plug end 15. A plug hole 22 of the core housing 20 may be connected to the other end of the ear hook 10 by being fixed to the first plug end 14. The housing sheath 17 may be molded on the ear hook 10. The housing sheath 17 may be further wrapped around the periphery of the circuit housing 30 in a sleeved manner. In some embodiments, the protective sleeve 16 and the housing sheath 17 may include soft material with certain elasticity, such as silica gel, rubber, or the like, or any combination thereof. In some embodiments, the housing sheath 17 may have a bag-like structure with an open end, and the circuit housing 30 may enter an inside of the housing sheath 17 through the open end of the housing sheath 17. The opening of the housing sheath 17 may be disposed on an end of the housing sheath 17 away from the protective sleeve 16, and the circuit housing 30 may enter the inside of the housing sheath 17 from the end of the housing sheath 17 away from the protective sleeve 16 and be covered by the housing sheath 17.

Figure 5:
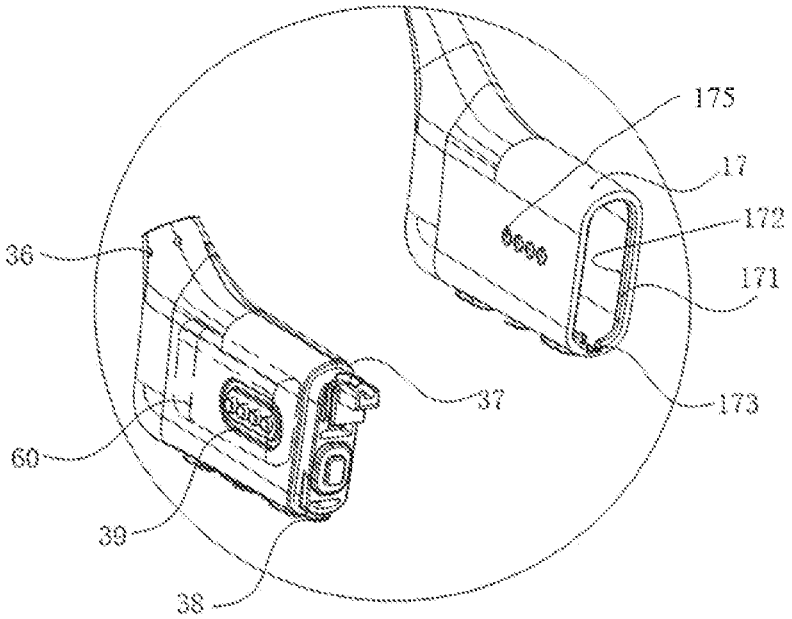
FIG. 5 is a schematic diagram illustrating a partially enlarged view of part E in FIG. 2.

FIG. 5 is a schematic diagram illustrating a partially enlarged view of part E in FIG. 2. Referring to FIG. 2 and FIG. 5, in some embodiments, an open end of the housing sheath 17 may include an annular flange 171 protruding inwardly. The end of the circuit housing 30 away from the ear hook 10 may have a stepped structure, so as to form an annular table 37. The annular flange 171 may abut on the annular table 37 when the housing sheath 17 covers the periphery of the circuit housing 30. The annular flange 171 may be formed by an inner wall surface of the open end of the housing sheath 17 protruding to a certain thickness toward the inside of the housing sheath 17. The annular flange 171 may include a flange surface 172 facing the ear hook 10. The annular table 37 may be opposite to the flange surface 172 and toward a direction of the circuit housing 30 away from the ear hook 10. A height of the flange surface 172 of the annular flange 171 may be not greater than a height of the annular table 37, the inner wall surface of the housing sheath 17 may abut the sidewall of the circuit housing 30, and the housing sheath 17 may tightly cover the periphery of the circuit housing 30 when the flange surface 172 of the annular flange 171 abuts the annular table 37. In some embodiments, a sealant may be applied to a joint area between the annular flange 171 and the annular table 37. Specifically, when the housing sheath 17 is used to cover the circuit housing 30, the sealant may be coated on the annular table 37 to seal the housing sheath 17 and the circuit housing 30.

In some embodiments, the circuit housing 30 may include a positioning block 38. The positioning block 38 may be disposed on the annular table 37 and extend along a direction of the circuit housing 30 away from the ear hook 10. Specifically, the positioning block 38 may be disposed on the auxiliary sidewall 34 of the circuit housing 30, and a thickness of the positioning block 38 protruding on the auxiliary sidewall 34 may be consistent with a height of the annular table 37. The number of the positioning blocks 38 may be one or more, which can be set according to an actual requirement. Correspondingly, the annular flange 171 of the housing sheath 17 may include a positioning groove 173 corresponding to the positioning block 38, and the positioning groove 173 may cover at least a portion of the positioning block 38 when the housing sheath 17 covers the periphery of the circuit housing 30.

Figure 6:
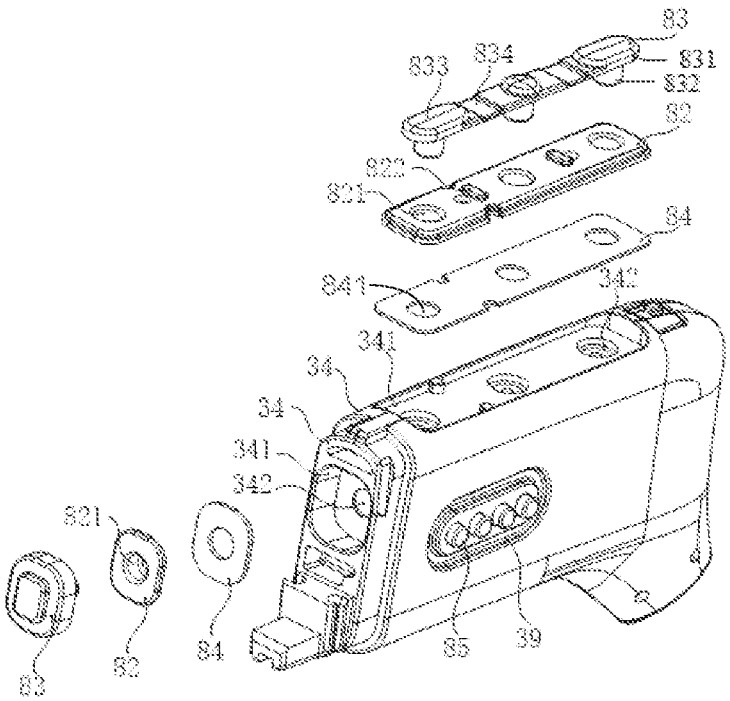
FIG. 6 is a schematic diagram illustrating an exploded view of partial structures of an exemplary circuit housing and an exemplary button mechanism according to some embodiments of the present disclosure.
Figure 7:
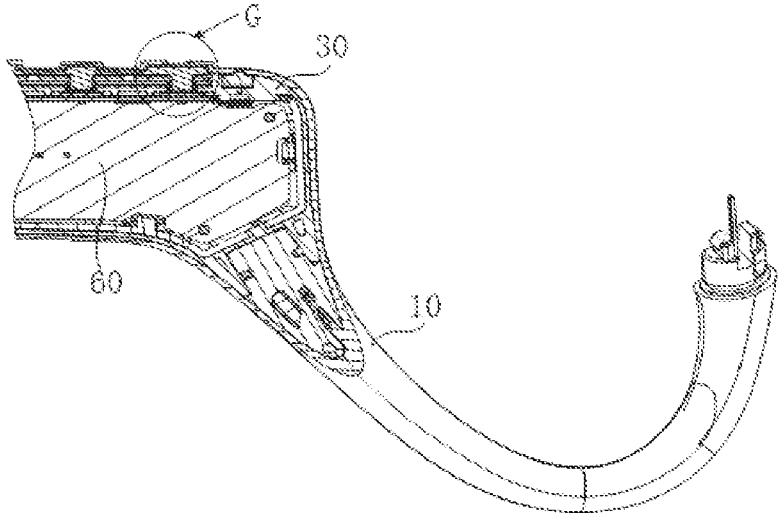
FIG. 7 is a schematic diagram illustrating cross-sectional views of partial structures of an exemplary circuit housing, an exemplary button mechanism, and an exemplary ear hook according to some embodiments of the present disclosure.
Figure 8:
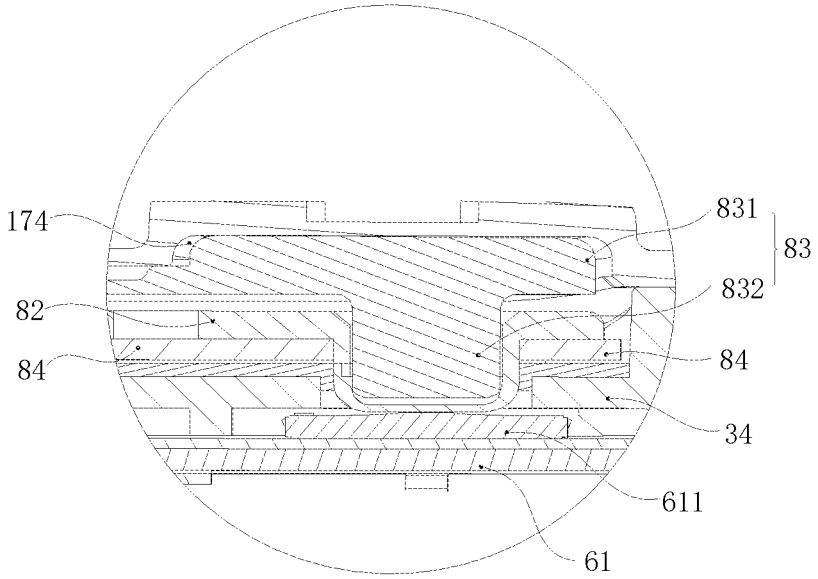
FIG. 8 is a schematic diagram illustrating a partially enlarged view of part G in FIG. 7.

FIG. 6 is a schematic diagram illustrating an exploded view of partial structures of an exemplary circuit housing and an exemplary button mechanism according to some embodiments of the present disclosure. FIG. 7 is a schematic diagram illustrating cross-sectional views of partial structures of an exemplary circuit housing, an exemplary button mechanism, and an exemplary ear hook according to some embodiments of the present disclosure. FIG. 8 is a schematic diagram illustrating a partially enlarged view of part G in FIG. 7. Referring to FIG. 2, FIG. 6, FIG. 7, and FIG. 8, in some embodiments, an MP3 player may include a button mechanism (e.g., a button 83). In this embodiment, two opposite sidewalls of the circuit housing 30 with a relatively large area may be main sidewalls 33, and two opposite sidewalls with a relatively small area connecting the two main sidewalls 33 may be auxiliary sidewalls 34. A first recessed area 341 may be disposed on an outer surface of the auxiliary sidewalls 34 of the circuit housing 30, and the first recessed area 341 may include a button hole 342 connecting the outer surface and an inner surface of the auxiliary sidewalls 34. The auxiliary sidewalls 34 of the circuit housing 30 may include an auxiliary sidewall facing toward a rear side of a user's head when the user wears the MP3 player, and may also include an auxiliary sidewall facing toward a lower side of the user's head when the user wears the MP3 player. The number (or count) of the first recessed areas 341 may be one or more, and each of the first recessed areas 341 may include one or more button holes 342. The count of the button holes 342 may be set according to actual needs, which is not specifically limited herein.

In some embodiments, the MP3 player may further include an elastic pad 82. The elastic pad 82 may be disposed in the first recessed area 341, and may be specifically fixed on an outer surface of the auxiliary sidewall 34 corresponding to the first recessed area 341, so as to cover a periphery of the button hole 342, and prevent external liquid from entering into the inside of the circuit housing 30 through the button hole 342, thereby improving sealing and waterproofing performance of the MP3 player. In some embodiments, the elastic pad 82 may include a second recessed area 821 corresponding to the button hole 342, and the second recessed area 821 may extend to an inside of the button hole 342. In some embodiments, the elastic pad 82 may made of soft material, such as soft silicone, rubber, or the like, or any combination thereof. In addition, the elastic pad 82 may be relatively thin, which makes it difficult to bond the elastic pad 82 firmly to the outer surface of the auxiliary sidewall 34 when the elastic pad 82 is directly bonded to the outer surface of the auxiliary sidewall 34.

In some embodiments, a rigid pad 84 may be disposed between the elastic pad 82 and the circuit housing 30. The rigid pad 84 and the elastic pad 82 may be fixed against each other, e.g., in a lamination manner, a bonding manner, an injection moulding manner, etc. Further, the rigid pad 84 may be bonded to the auxiliary sidewall 34, e.g., by using a double-sided adhesive, so as to form an adhesive layer between the rigid pad 84 and the auxiliary sidewall 34. In this case, the elastic pad 82 may be firmly fixed on the outer surface of the auxiliary sidewall 34. In addition, since the elastic pad 82 is soft and thin, it may be difficult for the elastic pad 82 to maintain a flat state when a user presses the button. By fixing the rigid pad 84, the elastic pad 82 may maintain flat.

In some embodiments, the rigid pad 84 may include a through hole 841 that allows the second recessed area 821 to pass through, such that the second recessed area 821 of the elastic pad 82 may further extend to the button hole 342 through the through hole 841. In some embodiments, the rigid pad 84 may include stainless steel, or other steel materials, such as a hard material (e.g., plastic material, etc.). The rigid pad 84 may be integrally formed to abut against the elastic pad 82.

In some embodiments, the button 83 may include a button body 831 and a button contact 832 protruding from one side of the button body 831. The button body 831 may be disposed on a side of the elastic pad 82 away from the circuit housing 30, and the button contact 832 may extend into the second recessed area 821 to extend into the button hole 342 along with the second recessed area 821. Since the MP3 player in this embodiment is relatively thin and/or light, a pressing stroke of the button 83 may be short. If a soft button is used, the user's pressing feeling may be affected, and bring a bad experience for the user. In some embodiments, the button 83 may include hard plastic material, such that the user may have a good feel when pressing the button 83.

In some embodiments, a control circuit 60 may include a button circuit board 61. The button circuit board 61 may be placed inside the circuit housing 30. The button circuit board 61 may include a button switch 611 corresponding to the button hole 342. Thus, when the user presses the button 83, the button contact 832 may contact and trigger the button switch 611 to implement a corresponding function.

In some embodiments, a second recessed area 821 may be disposed on the elastic pad 82. In this case, on the one hand, the second recessed area 821 may cover the button hole 342, which may improve the waterproof effect of the MP3 player. On the other hand, in a natural state, the button contact 832 may extend into the button hole 342 through the second recessed area 821, which may shorten the pressing stroke of the button to reduce the space occupied by the button mechanism. Thus, the MP3 player may not only have good waterproof performance, but also take up less space.

In some embodiments, the button 83 may include a button unit 833, and the count (or number) of the button unit 833 may be one or more. In an application scenario, the button 83 may include at least two button units 833 spaced from each other and a connection part 834 configured to connect the button units 833. The button units 833 may be integrated with the connection part 834. Each button unit 833 may correspond to a button contact 832, and further correspond to a button hole 342 and a button switch 611. Each first recessed area 341 may include a plurality of button units 833, and the user may trigger different button switches 611 by pressing different button units 833, and realize multiple functions.

In some embodiments, the elastic pad 82 may include an elastic convex 822 for supporting the connection part 834. Since the button 83 may include the plurality of button units 833 connected to each other, the elastic convex 822 may cause one of the button unit 833 to be pressed separately when the user presses the corresponding button unit 833, thereby avoiding that other button units 833 are pressed due to a linkage between the plurality of button units 833. In this case, the corresponding button switch 611 may be triggered accurately. It should be noted that the elastic convex 822 is not necessary. For example, the elastic convex 822 may be a protruding structure without elasticity, or the protruding structure may be removed. The elastic convex 822 may be set according to an actual condition. In some embodiments, the inner wall of the housing sheath 17 may include a concave 174 corresponding to the button 83, such that the periphery of the circuit housing 30 and the button 83 may be covered in a sleeved manner.

Figure 9:
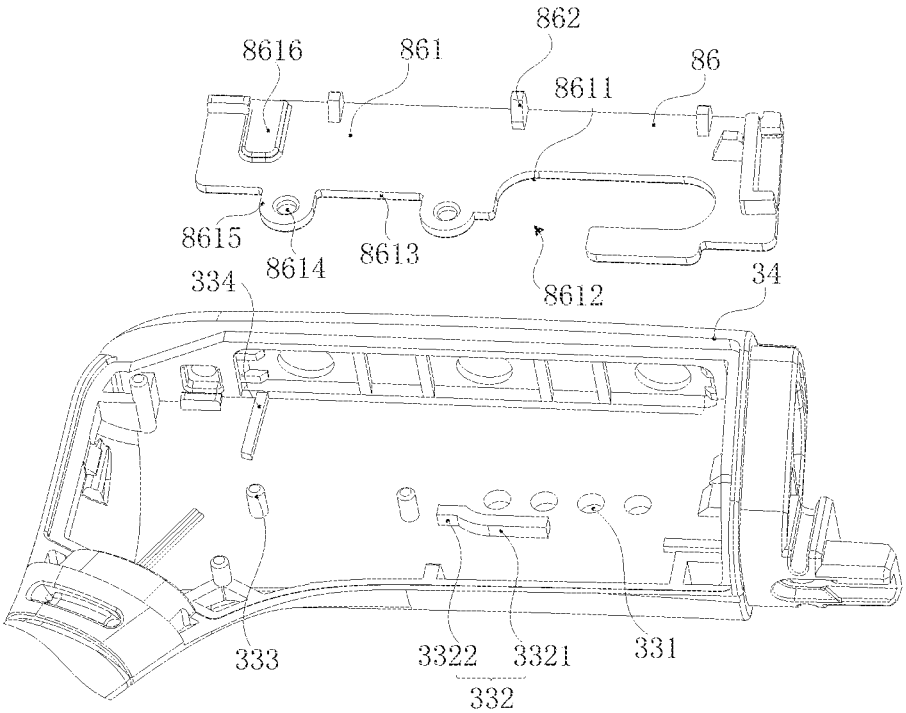
FIG. 9 is a schematic diagram illustrating an exploded view of partial structures of an exemplary circuit housing and an exemplary auxiliary film according to some embodiments of the present disclosure.
Figure 10:
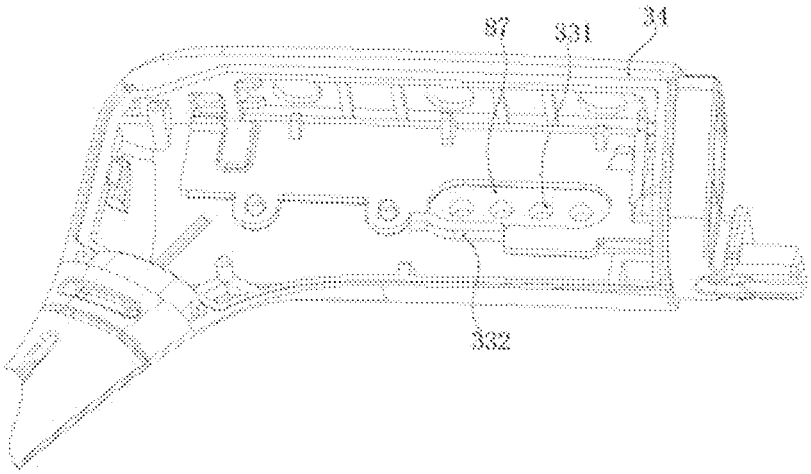
FIG. 10 is a schematic diagram illustrating partial structures of an exemplary circuit housing and an exemplary auxiliary film according to some embodiments of the present disclosure.

FIG. 9 is a schematic diagram illustrating an exploded view of partial structures of an exemplary circuit housing and an exemplary auxiliary film according to some embodiments of the present disclosure. FIG. 10 is a schematic diagram illustrating partial structures of an exemplary circuit housing and an exemplary auxiliary film according to some embodiments of the present disclosure. Referring to FIG. 2, FIG. 9, and FIG. 10, in some embodiments, an MP3 player may include an auxiliary film 86 located inside the circuit housing 30. The auxiliary film 86 may include a board 861. The board 861 may include a hollow region 8611. The board 861 may be disposed on an inner surface of the main sidewall 33 by means of hot melting or hot pressing, bonding, etc. A mounting hole 331 on the main sidewall 33 may be located inside the hollow region 8611. Specifically, a board surface of the board 861 may abut against the inner surface of the main sidewall 33 in parallel. The auxiliary film 86 may have a certain thickness. After the auxiliary film 86 is placed on the inner surface of the main sidewall 33, an inner sidewall of the hollow region 8611 of the auxiliary film 86 and the main sidewall 33 may form a glue tank 87 located on a periphery of a conductive post 85 inserted in the mounting hole 331.

In some embodiments, a sealant may be applied in the glue tank 87, such that the mounting hole 331 may be sealed from the inside of circuit housing 30 to improve the tightness of the circuit housing 30, thereby improving the waterproof performance of the MP3 player.

In some embodiments, a material of the auxiliary film 86 may be the same as that of the circuit housing 30. In some embodiments, the auxiliary film 86 and the circuit housing 30 may be separately formed. It should be noted that, during a moulding stage of the circuit housing 30, there may be other structures near the mounting hole 331, such as the button hole 342 to be moulded, etc. Molds corresponding to these structures during moulding may need to be withdrawn from the inside of the circuit housing 30. At this time, if the glue tank 87 corresponding to the mounting hole 331 is integrated directly inside the circuit housing 30, a convex of the glue tank 87 may hinder a smooth withdrawal of the moulds corresponding to these structures, thereby causing inconvenience to the production of the MP3 player. In this embodiment, the auxiliary film 86 and the circuit housing 30 may be independent structures. After forming the two structures separately, the auxiliary film 86 may be installed inside the circuit housing 30 to form the glue tank 87 together with the main sidewall 33 of the circuit housing 30. In this way, during the moulding stage of the circuit housing 30, the moulds of a portion of the structures may be not hindered from withdrawing from the inside of the circuit housing 30, which may be beneficial to smooth production.

In some embodiments, when moulding the circuit housing 30, the withdrawal of the moulds may only take up part of the space occupied by the glue tank 87. Without affecting the withdrawal of the moulds, a part of the glue tank 87 may be integrated on the inner surface of the main sidewall 33, and the other parts of the glue tank 87 may still be formed by the auxiliary film 86.

In some embodiments, the inner surface of the main sidewall 33 may be integrated with a first striped convex rib 332. A position of the first striped convex rib 332 may not affect the withdrawal of the mould of the circuit housing 30. The hollow region 8611 of the auxiliary film 86 may include a notch 8612. The first striped convex rib 332 may correspond to the notch 8612. After the circuit housing 30 and the auxiliary film 86 are formed respectively, the auxiliary film 86 may be placed on the inner surface of the main sidewall 33, such that the first striped convex rib 332 may be at least partially fitted to the notch 8612. The first striped convex rib 332 and the auxiliary film 86 may be combined to make the glue tank 87 closed.

In this embodiment, since the first striped convex rib 332 does not hinder the withdrawal of the mould, a sidewall of the glue tank 87 may be formed by the first striped convex rib 332 and auxiliary film 86. The first striped convex rib 332 may be integrally formed on the inner surface of the main sidewall 33.

In some embodiments, the first striped convex rib 332 may further extend to abut against a side edge 8613 of the board 861, thereby positioning the board 861. The first striped convex rib 332 may include a rib body 3321 and an arm 3322. The rib body 3321 may be configured to match and fit with the notch 8612 of the hollow region 8611, thereby forming a sidewall of the glue tank 87. The arm 3322 may be formed by a further extension of one end of the rib body 3321, and may extend to a side edge 8613 of the board 861 to abut against the side edge 8613, such that the board 861 may be positioned at the side edge 8613.

In some embodiments, a protrusion height of the first striped convex rib 332 on the inner surface of the main sidewall 33 may be greater than, smaller than, or equal to a thickness of the auxiliary film 86, as long as the first striped convex rib 332 and the auxiliary film 86 may form the glue tank 87, and position the board 861 of the auxiliary film 86. The protrusion height of the first striped convex rib 332 is not limited herein.

In some embodiments, the board 861 may include a positioning hole 8614, and the positioning hole 8614 may penetrate through a main board surface of the board 861. The inner surface of the main sidewall 33 may be integrated with the positioning post 333 corresponding to the positioning hole 8614. After the auxiliary film 86 is placed on the inner surface of the main sidewall 33, the positioning post 333 may be inserted into the positioning hole 8614, thereby further positioning the auxiliary film 86. The number (or count) of the positioning holes 8614 may be equal to the count of the positioning posts 333. In this embodiment, the number (or the count) of the positioning holes 8614 or that of the positioning posts 333 may be two.

In an application scenario, at least two lugs 8615 may be formed on a side edge 8613 of the board 861, and two positioning holes 8614 may be placed on corresponding lugs 8615, respectively. The inner surface of the main sidewall 33 may be integrated with a second striped convex rib 334. The second striped convex rib 334 may extend in a direction toward the auxiliary sidewall 34, and may be perpendicular to an extending direction of the arm 3322 of the first striped convex rib 332. The board 861 may also include a bar-shaped positioning groove 8616 corresponding to the second striped convex rib 334. The positioning groove 8616 may be recessed along a direction away from the main sidewall 33, and one end of the positioning groove 8616 may be connected to the side edge 8613 of the board 861 and may be perpendicular to the side edge 8613.

In an application scenario, the positioning groove 8616 may be formed by a recession of a surface of the board 861 that abuts against the main sidewall 33. A depth of the positioning groove 8616 may be less than the thickness of the board 861. In this case, a surface of the board 861 opposite to the recessed surface of the board 861 may be not affected by the positioning groove 8616. In another application scenario, the depth of the positioning groove 8616 may be greater than a thickness of the board 861, such that when a surface of the board 861 close to the main sidewall 33 is recessed, the other opposite surface of the board 861 may protrude toward a recessed direction, thereby forming the positioning groove 8616. After the auxiliary film 86 is placed on the inner surface of the main sidewall 33, the second striped convex rib 334 may be embedded in the positioning groove 8616 to further position the board 861.

Referring to FIG. 2, FIG. 5, and FIG. 6, in some embodiments, the housing sheath 17 may include an exposed hole 175 corresponding to the conductive post 85. After the housing sheath 17 is sleeved over the periphery of the circuit housing 30, one end of the conductive post 85 located outside the circuit housing 30 may be exposed through the exposed hole 175, and then connected to an external circuit of the MP3 player, such that the MP3 player may receive power supply or perform data transmission through the conductive post 85.

In some embodiments, the outer surface of the circuit housing 30 may be recessed with a glue tank 39 surrounding a plurality of mounting holes 331. Specifically, a shape of the glue tank 39 may include an oval ring. The plurality of mounting holes 331 may be respectively disposed on the circuit housing 30 surrounded by the glue tank 39 with the shape of oval ring. A sealant may be applied to the glue tank 39. After the housing sheath 17 and the circuit housing 30 are assembled, the housing sheath 17 may be connected to the circuit housing 30 on a periphery of the mounting hole 331 via the sealant. In this way, when external liquid enters the inside of the housing sheath 17 through the exposed hole 175, the housing sheath 17 may be protected from sliding around the periphery of the circuit housing 30, and the mounting hole 331 may be further sealed from the outside of the circuit housing 30, which may further improve the tightness of the circuit housing 30 and improve the waterproof performance of the MP3 player.

It should be noted that the above descriptions of the MP3 player are only specific examples and should be not regarded as the only feasible implementation solution. Obviously, for those skilled in the art, after understanding the basic principles of the MP3 player, various modifications and changes in forms and details of the specific methods and steps for implementing the MP3 player may be made without departing from the principles. For example, the number of the first recessed area(s) (e.g., the first recessed area 341) may be multiple, and each of the first recessed areas may include one or more button holes, which are not limited herein. Such modifications, changes, and variations are all within the protection scope of the present disclosure.

Figure 11:
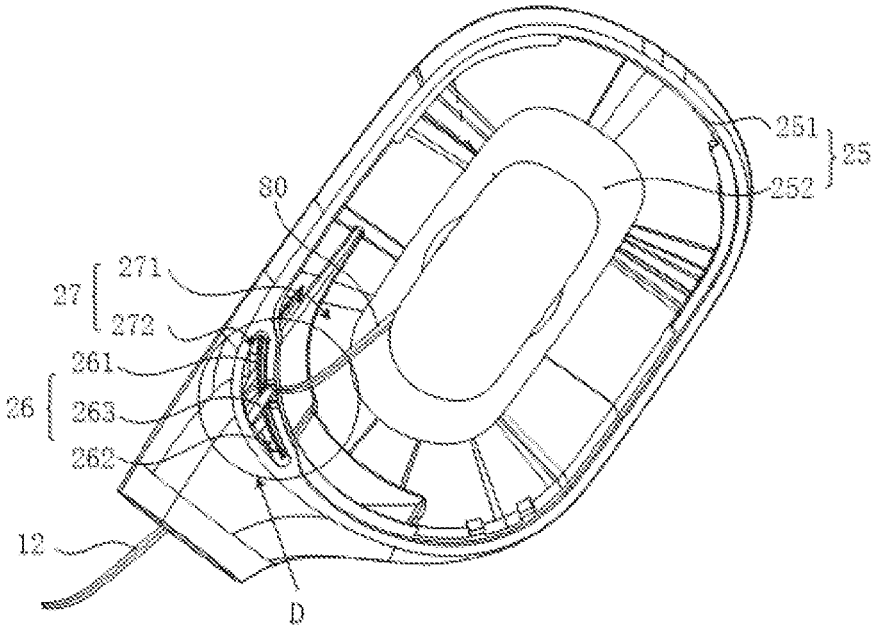
FIG. 11 is a schematic diagram illustrating an exemplary core housing of the MP3 player according to some embodiments of the present disclosure.
Figure 12:
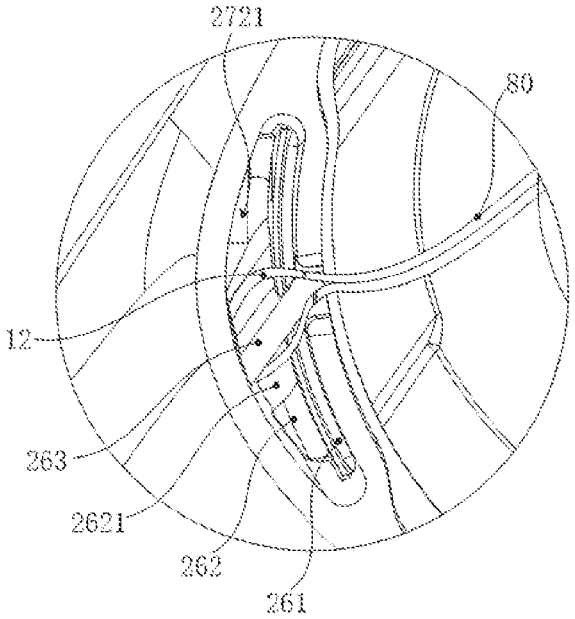
FIG. 12 is a partially enlarged view of the D portion in FIG. 11.
Figure 13:
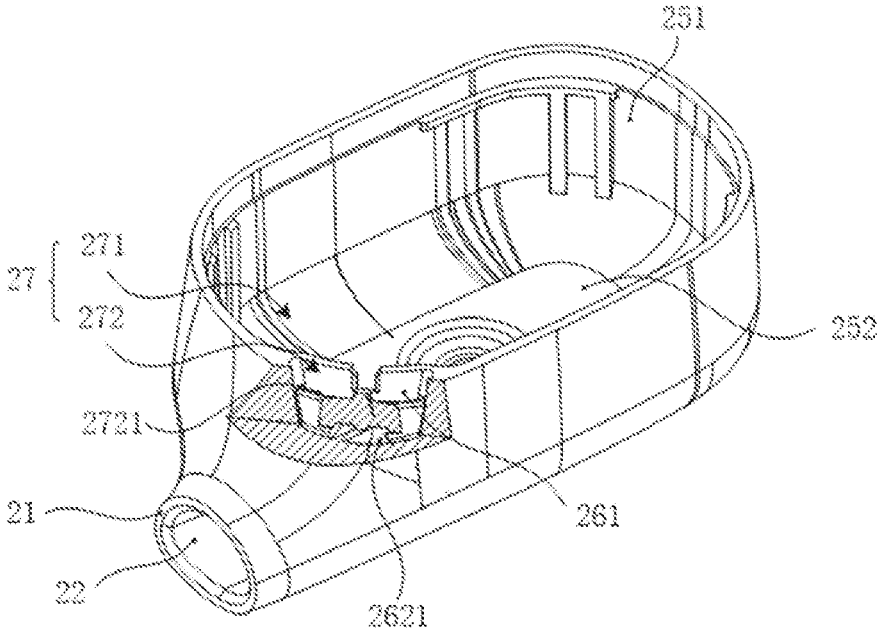
FIG. 13 is a schematic diagram illustrating a partial cross-section of the core housing of the MP3 according to some embodiments of the present disclosure.

FIG. 11 is a schematic diagram illustrating an exemplary core housing of the MP3 player according to some embodiments of the present disclosure. FIG. 12 is a partially enlarged view of the D portion in FIG. 11. FIG. 13 is a schematic diagram illustrating a partial cross-section of the core housing of the MP3 according to some embodiments of the present disclosure.

Combining FIG. 11, FIG. 12, and FIG. 13, In some embodiments, the core housing may include a main housing 25 and a partition assembly. In some embodiments, the partition assembly 26 may be located inside the main housing 25 and may be connected to the main housing 25, thereby separating an inner space 27 of the main housing 25 into a first housing space 271 and a second housing space 272 near a plug hole 22. In some embodiments, the main housing 25 may include a peripheral sidewall 251 and a bottom wall 252 connected to one end surface of the peripheral sidewall. The peripheral sidewall 251 and the bottom wall 252 may form the inner space 27 of the main housing 25.

In some embodiments, the partition assembly 26 may be located on one side of the main housing near the plug hole 22 and may include a side partition 261 and a bottom partition 262. The side partition 261 may be disposed along a direction perpendicular to the bottom wall 252, and two ends of the side partition 261 may be connected to the peripheral sidewall 251, thereby separating the inner space 27 of the main housing 25. The bottom partition 262 may be parallel or nearly parallel to the bottom wall 252 and spaced apart. The bottom partition 262 may be connected to the peripheral sidewall 251 and the side partition 261 respectively, thereby dividing the inner space 27 formed by the main housing 25 into two spaces, which are the first housing space surrounded by the side partition 261, the bottom partition 262, the peripheral sidewall 251 far away from the plug hole 22, and the bottom wall 252, and the second housing space 272 surrounded by the bottom partition 262, the side partition 261, and the peripheral sidewall 251 adjacent to the plug hole 22. The second housing space 272 may be smaller than the first housing space 271. In some embodiments, the partition assembly 26 may also divide the inner space 27 of the main housing 25 through other arrangements, which are not specifically limited here.

In some embodiments, the partition assembly 26 may further include an inner partition 263. The inner partition 263 may further divide the second housing space 272 into two sub-housing spaces 2721. Specifically, the inner partition 263 may be arranged perpendicular to the bottom wall 252 of the main housing 25, be connected to the side partition 261 and the peripheral sidewall 251, and further extend to the wiring hole 2621, thereby dividing the second housing space 272 into two sub-housing spaces 2721, and dividing the wiring hole 2621 into two wiring holes. Each of the two wiring holes 2621 may be connected to the corresponding sub-housing spaces 2721.

In some embodiments, the second housing space 272 may be further filled with sealant. In this way, the second housing space 272 may be further fixed to the wire 12 and the wire 80, which may further reduce an adverse effect of the sound quality due to a wire vibration, thereby improving the sound quality of the bone conduction speaker and protecting a welding point between the wire 12 and the wire 80. Besides, by filling the second housing space 272 with the sealant, a waterproof function may be achieved.

It should be noted that the above descriptions of the MP3 player are only specific examples and should not be regarded as the only feasible implementation solution. Obviously, for those skilled in the art, after understanding the basic principles of the MP3 player, various modifications and changes in forms and details of the specific methods and steps for implementing the MP3 player may be made without departing from the principles. For example, the second housing space 272 may also be greater than or the first housing space 271, or the second housing space 272 may be equal to the first housing space 271. Such modifications, changes, and variations are all within the protection scope of the present disclosure.

Figure 14:
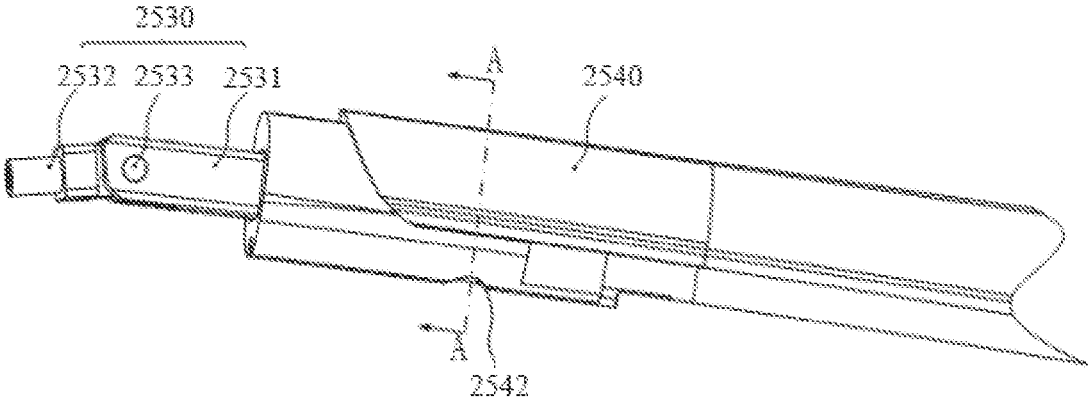
FIG. 14 is a schematic structural diagram illustrating an exemplary hinge component according to some embodiments of the present disclosure.
Figure 15:
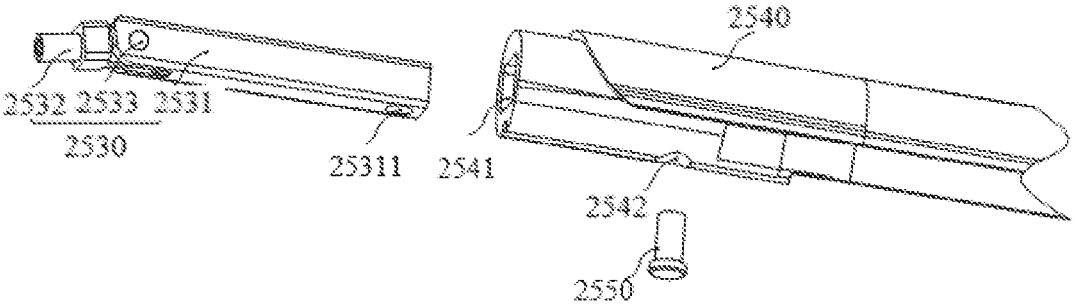
FIG. 15 is a schematic diagram illustrating an exploded view of an exemplary hinge component according to some embodiments of the present disclosure.

FIG. 14 is a schematic structural diagram illustrating an exemplary hinge component according to some embodiments of the present disclosure. FIG. 15 is a schematic diagram illustrating an exploded view of an exemplary hinge component according to some embodiments of the present disclosure. As shown in FIG. 14 and FIG. 15, the hinge component may include a hinge 2530, which is a structure used to connect two solid bodies and allow relative rotation between them. In some embodiments, the connection between the ear hook 10 and the core housing 20 may also be performed by means of the hinge joint. In some embodiments, the ear hook 10 and the core housing 20 may also be connected through a hinge, and a fitting position between the core housing 20 and a human skin may be adjusted by a hinge component.

Referring to FIG. 2, FIG. 14 and FIG. 15, the hinge component may be disposed at an end of the ear hook 10 away from the circuit housing 30. The hinge component may connect with the core housing 20 to the end of the ear hook 10 far from the circuit housing 30 through the hinge 2530. In some embodiments, the hinge component may include a rod-like component 2540 and a fixing component 2550. In some embodiments, the hinge 2530 may include a hinge base 2531 and a hinge arm 2532. The hinge arm 2532 may be rotatably connected to the hinge base 2531 through a rotation shaft 2533. The hinge base 2531 and the hinge arm 2532 may be respectively connected to two components that need to be rotationally connected. The two components may be rotationally connected together through the rotation shaft 2533 of the hinge 2530. For example, the hinge base 2531 may be fixed to the ear hook 10, and the hinge arm 2532 may be connected to the core housing 20.

In some embodiments, the hinge base 2531 of the hinge 2530 may be connected to the rod-like component 2540. In some embodiments, the rod-like component 2540 may be a partial structure or an overall structure of one of the two members rotationally connected through the hinge 2530. In some embodiments, the rod-like component 2540 may be a connection structure in which one of the two members requiring rotational connection is connected to the hinge 2530. When the hinge component is used in an MP3 player, the rod-like component 2540 may be at least a part of the ear hook 10 of the MP3 player. For example, the rod-like component 2540 may be all of the ear hook 10. As another example, the rod-like component 2540 may be part of the end of the ear hook 10 away from the circuit housing 30. In some embodiments, the hinge 2530 may be set at the end of the ear hook away from the circuit housing 30 through the part of the ear hook 10.

In some embodiments, the rod-like component 2540 may be disposed along the length direction with a hinge cavity 2541 communicating with the end surface of the rod-like component 2540. A sidewall of the rod-like component 2540 may be disposed with a first insertion hole 2542 communicating with the hinge cavity 2541. The end of the hinge base 2531 away from the hinge arm 2532 may be inserted into the hinge cavity 2541 from the end surface of the rod-like component 2540, and may be fixed in the hinge cavity 2541 by the fixing component 2550 inserted in the first insertion hole 2542. In some embodiments, the hinge cavity 2541 may communicate with the ear hook 10 away from the end face of the end of the circuit housing 30. The hinge base 2531 may be inserted into the hinge cavity 2541. The hinge 2530 may be connected to the ear hook 10.

In some embodiments, the first insertion hole 2542 may be formed by the rod-like component 2540 during the moulding process, or may be formed on the sidewall of the rod-shaped member by a mean such as drilling after the moulding. In some embodiments, the shape of the first insertion hole 2542 may be circular. In some embodiments, the shape of the first insertion hole 2542 may be other shapes (e.g., a square, a triangle, etc.). The shape of the fixing component 2550 may match the shape of the first insertion hole 2542. The fixing component 2550 may be inserted into the first insertion hole 2542 from the outside of the rod-like component 2540. The hinge base 2531 may be fixed in the hinge cavity 2541 by abutting the sidewall of the hinge base 2531. In some embodiments, the hinge base 2531 may be fixed in the hinge cavity 2541 by penetrating and inserting into the outer wall of the hinge base 2531. In some embodiments, a matching thread may be disposed on the inner wall of the first insertion hole 2542 and the outer wall of the fixing component 2550. The fixing component 2550 may be connected to the first insertion hole 2542 by screwing to further fix the hinge base 2531 in the hinge cavity 2541. In some embodiments, the first insertion hole 2542 and the fixing component 2550 may be connected by an interference fit.

In some embodiments, the hinge arm 2532 may be connected with other components. After connecting with the hinge arm 2532, the component may be further able to rotate around the rotation shaft 2533 by being mounted in the hinge cavity 2541 of the rod-like component 2540 with the hinge base 2531 or other components connected with the rod-like component 2540. For example, when the hinge component is used in the MP3 player, the core housing 20 may be connected to the end of the hinge arm 2532 away from the hinge base 2531. The core housing 20 of the earphone core 50 may be connected to the end of the ear hook 10 away from the circuit housing 30 through the hinge 2530.

In some embodiments, the rod-like component 2540 may be disposed with the hinge cavity 2541 connected to an end surface of the rod-like component 2540. The hinge 2530 may accommodate the hinge base 2531 in the hinge cavity 41, and further penetrate the fixing component 2550 through the sidewall of the rod-like component 2540 through the first insertion hole 2542, thereby fixing the hinge base 2531 accommodated in the hinge cavity 2541 in the hinge cavity 2541. The hinge 2530 may be detached from the rod-like component 2540 to facilitate replacement of the hinge 2530 or the rod-like component 2540. In some embodiments, the hinge 2530 and the core housing 20 of the MP3 player may be detachable relative to the ear hook 10, thereby facilitating replacement when the core housing 20 of the earphone core 50 or the ear hook 10 is damaged.

In some embodiments, the hinge base 2531 may be disposed with a second insertion hole 25311 corresponding to the first insertion hole 2542. The fixing component 2550 may be further inserted into the second insertion hole 25311. In some embodiments, the shape of the second insertion hole 25311 may match the shape of the fixing component 2550. The fixing component 2550 may be inserted into the second insertion hole 25311 to fix the hinge base 2531 after passing through the first insertion hole 2542. The shaking of the hinge base 2531 in the hinge cavity 2541 may be reduced, and the hinge 2530 may be fixed more firmly. In some embodiments, the inner wall of the second insertion hole 25311 may be disposed with matching threads on the outer wall corresponding to the fixing component 2550. The fixing component 2550 and the hinge base 2531 may be screwed together. In some embodiments, the inner wall of the second insertion hole 25311 and the outer sidewall at the corresponding contact positions of the fixing component 2550 may be smooth surfaces. The fixing component 2550 and the second insertion hole 25311 may be in interference fit. In some embodiments, the second insertion hole 25311 may be disposed through both sides of the hinge base 2531. The fixing component 2550 may further penetrate the entire hinge base 2531. The hinge base 2531 may be firmly fixed in the hinge cavity 2541.

In some embodiments, the cross-sectional shape of the hinge base 2531 may match the cross-sectional shape of the hinge cavity 2541 in a cross section perpendicular to the length direction of the rod-like component 2540. A seal may be formed between the hinge base 2531 and the rod-like component 2540 after insertion. In some embodiments, the cross-sectional shape of the hinge base 2531 and the cross-sectional shape of the hinge cavity 2541 may be any shapes, as long as the hinge base 2531 may be inserted into the hinge cavity 2541 from the end of the rod-like component 2540 away from the hinge arm 2532. In some embodiments, the first insertion hole 2542 may be disposed on the sidewall of the hinge cavity 2541, penetrate the sidewall of the hinge cavity 2541 and communicate with the hinge cavity 2541.

In some embodiments, the cross-sectional shape of the hinge base 2531 and the cross-sectional shape of the hinge cavity 2541 may be both rectangular. The first insertion hole 2542 may be perpendicular to one side of the rectangle. In some embodiments, the corners of the outer wall of the hinge base 2531 or the corners of the inner wall of the hinge cavity 2541 may be rounded. The contact between the hinge base 2531 and the hinge cavity 2541 may be smooth. The hinge base 2531 may be smoothly inserted into the hinge cavity 2541.

In some embodiments, the hinge component may include a connection line provided outside the hinge 2530. In some embodiments, the connection line may be a connection line having an electrical connection function and/or a mechanical connection function. The hinge component may be configured to connect the end of core housing 20 and the ear hook 10 away from the circuit housing 30. The control circuit or the like related to the core housing 20 may be disposed in the ear hook 10 or the circuit housing 30. The connecting wire 2560 may electrically connect a core housing 20 with a control circuit in the ear hook 10 or the circuit housing 30. In some embodiments, the connecting wire 2560 may be located at one side of the hinge base 2531 and the hinge arm 2532. The hinge 2530 may be disposed in the same accommodation space.

In some embodiments, the hinge base 2531 may include a first end surface. The hinge arm 2532 may have a second end surface opposite to the first end surface. It is easily understood that there is a certain gap between the first end surface and the second end surface, so that the hinge base 2531 and the hinge arm 2532 may be relatively rotated around the rotation shaft 2533. In some embodiments, during the relative rotation of the hinge arm 2532 and the hinge base 2531, the relative position between the first end surface and the second end surface changes accordingly, so that the gap between the two becomes larger or smaller.

In some embodiments, the gap between the first end surface and the second end surface may be always larger than or less than the diameter of the connecting wire 2560. The connecting wire 2560 located outside the hinge 2530 may not be caught in the gap between the first end surface and the second end surface during the relative rotation of the hinge base 2531 and the hinge arm 2532, thereby reducing the damage of the connecting wire 2560 by the hinge. In some embodiments, the ratio of the gap between the first end surface and the second end surface to the diameter of the connection line during the relative rotation of the hinge arm 2532 and the hinge base 2531 may always be greater than 1.5 (e.g., greater than 1.5, 1.7, 1.9, 2.0, etc.) or less than 0.8 (e.g., less than 0.8, 0.6, 0.4, 0.2, etc.).

Figure 16:
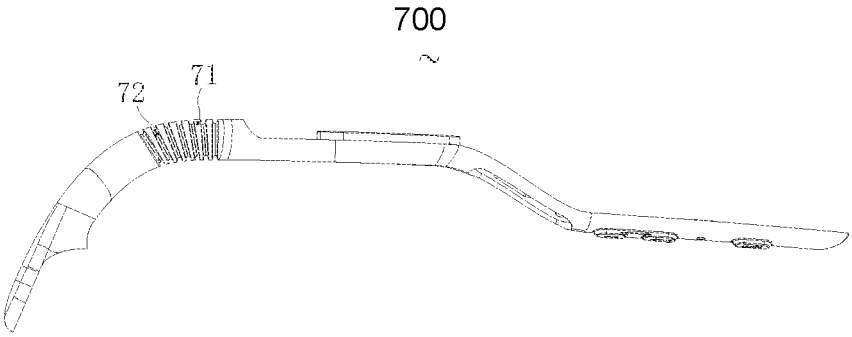
FIG. 16 is a schematic structural diagram illustrating an exemplary hinge component according to some embodiments of the present disclosure.
Figure 17:
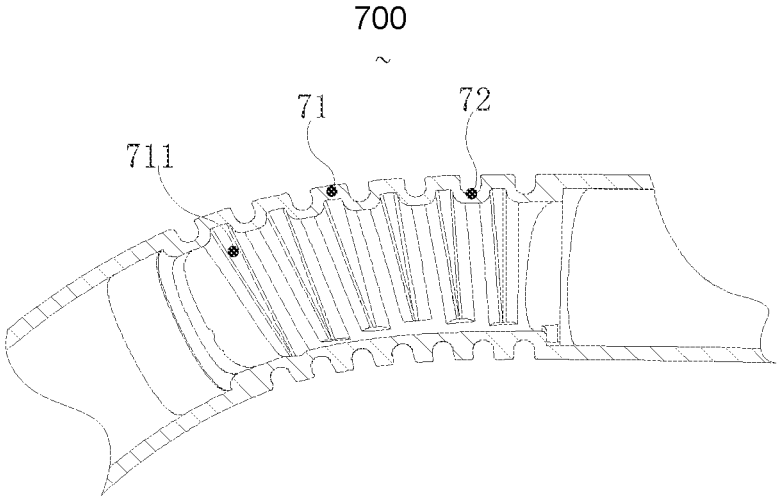
FIG. 17 is a schematic diagram illustrating a partial cross-sectional view of an exemplary hinge component according to some embodiments of the present disclosure.

FIG. 16 is a schematic structural diagram illustrating an exemplary hinge component according to some embodiments of the present disclosure. FIG. 17 is a schematic diagram illustrating a partial cross-sectional view of an exemplary hinge component according to some embodiments of the present disclosure. As shown in FIG. 16 and FIG. 17, in some embodiments, the hinge component may further include a protective sleeve 700. The protective sleeve 700 may be sleeved on the periphery of the hinge 2530 and may be bent along with the hinge 2530. In some embodiments, the protective sleeve 700 may include a plurality of annular ridge portions 71 spaced apart along the length direction of the protective sleeve 700 and an annular connection part 72 provided between the annular ridge portions 71. The protective sleeve 700 may be used to connect two adjacent annular ridge portions. In some embodiments, the tube wall thickness of the annular ridge portion 71 may be greater than the tube wall thickness of the annular connection part 72. The length direction of the protective sleeve 700 may be consistent with the length direction of the hinge 2530. The protection sleeve 70 may be specifically disposed along the length direction of the hinge base 2531 and the hinge arm 2532. The protective sleeve 700 may include the soft material, such as the soft silicone, the rubber, or the like, or any combination thereof.

In some embodiments, the annular ridge portion 71 may be formed by protruding outwardly from the outer sidewall of the protective sleeve 700. The shape of the inner sidewall of the protective sleeve 700 corresponding to the annular ridge portion 71 may be not limited herein. For example, the surface of inner wall may be smooth. As another example, a recess on the inner wall may be disposed at a position corresponding to the annular ridge portion 71. The annular connection part 72 may be configured to connect adjacent annular ridge portions 71, specifically connected to the edge region of the annular ridge portion 71 near the inside of the protective sleeve 700. A side of the outer wall of the protective sleeve 700 may be disposed in a recess with respect to the annular ridge portion 71.

When the hinge base 2531 and the hinge arm 2532 of the hinge 2530 are relatively rotated around the rotation shaft 2533, the angle between the hinge base 2531 and the hinge arm 2532 may change. The protective sleeve 700 may be bent. In some embodiments, when the protective sleeve 700 is bent with the hinge 2530, the annular ridge 71 and the annular connection part 72 located in the outer region of the bent shape formed by the protective sleeve 700 may be in a stretched state. The annular ridge 71 and annular connection part 72 located in the inner region of the bent shape may be in a squeezed state.

The tube wall thicknesses of the annular ridge portion 71 and the annular connection part 72 may refer to the thickness between the inner and outer walls of the protective sleeve 700 corresponding to the annular ridge portion 71 and the annular connection part 72, respectively. In some embodiments, the thickness of the pipe wall of the annular ridge portion 71 may be greater than the thickness of the pipe wall of the annular connection part 72. The annular ridge portion 71 may be harder than the annular connection part 72. Therefore, when the protective sleeve 700 is in a bent state, the protective sleeve 700 on the outer side of the bent shape may be in a stretched state. The annular ridge portion 71 may provide a certain strength support for the protective sleeve 700. When the protective sleeve 700 region on the inner side in the bent state is squeezed, the annular ridge portion 71 may withstand a certain pressing force, thereby protecting the protective sleeve 700 and improving the stability of the protective sleeve 700. The service life of the protective sleeve 700 may be extended.

In some embodiments, the shape of the protective sleeve 700 may be consistent with the state of the hinge 2530. In some embodiments, two sides of the protective sleeve 700 along the length direction and rotated around the rotation axis may be stretched or squeezed. In some embodiments, the hinge base 2531 and the hinge arm 2532 of the hinge 2530 may only rotate around the rotation shaft 2533 within a range of less than or equal to 180°. The protective sleeve 700 may only be bent toward one side, then one side of the two sides of the protective sleeve 700 in the length direction may be squeezed. The other side may be stretched. At this time, according to the different forces on both sides of the protective sleeve 700, the two sides of the protective sleeve 700 under different forces may have different structures.

In some embodiments, the width of the annular ridge portion 71 along the length direction of the protective sleeve 700 when the protective sleeve 700 is in a bent state toward the outside of the bent shape formed by the protective sleeve 700 may be greater than the width in the longitudinal direction of the protective sleeve 700 toward the inside of the bent shape. Increasing the width of the annular ridge 71 in the length direction of the protective sleeve 700 may further increase the strength of the protective sleeve. In some embodiments, the angle of the initial angle between the hinge base 2531 and the hinge arm 2532 may be less than 180°. If the annular ridges 71 of the protective sleeve 700 are evenly arranged, the protective sleeve 700 will be squeezed in the original state. In some embodiments, the width of the annular ridge 71 corresponding to the outer region side of the bent shape in the bent state is larger, thereby enlarging the length of the side protective sleeve 700. The strength of the protective sleeve 700 may be improved. The extent of the stretching side may be reduced when the protective sleeve 700 is bent. At the same time, the width of the annular ridge portion 71 along the longitudinal direction of the protective sleeve 700 may be smaller when the protective sleeve 700 is in a bent state toward the inner region side of the bent shape, which can increase the space of the extruded annular connection part 72 in the length direction of the protective sleeve 700 and alleviate the extrusion of the extrusion side.

In some embodiments, the width of the annular ridge portion 71 may gradually decrease from the side of the outer region toward the bent shape to the side of the inner region toward the bent shape. When the protective sleeve 700 is in the bent state, the width toward the outer region side of the bent shape formed by the protective sleeve 700 may be greater than the width toward the inner region side of the bent shape. The annular ridge portion 71 may be disposed around the periphery of the protective sleeve 700. In the length direction of the protective sleeve 700, one side corresponds to the stretched side, and the other side corresponds to the squeezed side. In some embodiments, the width of the annular ridge portion 71 may gradually decrease from the side of the outer region facing the bent shape to the side of the inner region facing the bent shape, thereby making the width more uniform. The stability of the protective sleeve 700 may be improved.

In some embodiments, when the protective sleeve 700 is in a bent state, the annular ridge portion 71 may be disposed with a groove 711 on an inner circumferential surface of the protective sleeve 700 inside the protective sleeve 700 on the outer region side of the bent shape formed by the protective sleeve 700. The groove 711 may be disposed along a length direction perpendicular to the protective sleeve 700. The corresponding annular ridge portion 71 may be appropriately extended when the protective sleeve 700 is stretched in the length direction. When the protective sleeve 700 is in a bent state, the protective sleeve 700 on the outer side of the bent shape formed by the protective sleeve 700 may be in a stretched state. A groove 711 may be disposed on the inner ring surface inside the protective sleeve 700 corresponding to the corresponding annular ridge portion 71, so that when the side protective sleeve is stretched, the annular ridge portion 71 corresponding to the groove 711 may be appropriately extended to bear a partial stretch, thus reducing the tensile force experienced by the side protective sleeve, thereby protecting the protective sleeve 700.

It should be noted that when the protective sleeve 700 is in a bent state, the annular ridge portion 71 on the side facing the inner region of the bent shape may not be disposed with a groove 711 on the inner sidewall of the corresponding protective sleeve 700. In some embodiments, the width of the groove 711 along the length of the protective sleeve 700 gradually decreases from the side of the outer region facing the bent shape to the side of the inner region facing the bent shape, so that no groove 711 is disposed on the inner sidewall of the protective sleeve 700 corresponding to the annular ridge portion 71 facing the inner region side of the bent shape.

In some embodiments, when the hinge component is applied to an MP3 player (as shown in FIG. 2) of a speaker device of the present disclosure, the protective sleeve 700 may be connected to the ear hook 10 and the core housing 20 which are respectively disposed on both sides in the longitudinal direction of the protective sleeve 700. In some embodiments, the protective sleeve 700 may also be other structures in the MP3 player. For example, the protective cover of some components may be integrally formed, so that the MP3 player may be more closed and integrated.

It should be noted that the hinge component in the present disclosure embodiment may not only be used in the MP3 player of the speaker device, but may also be used in other apparatuses, such as glasses, the headphone, and the hearing aid. In some embodiments, the hinge component may also include the rod-like component 2540, the fixing component 2550, the connecting wire 2560, the protective sleeve 700, etc., or other components related to the hinge 2530. The hinge component may realize the corresponding functions of the other components.

It should be noted that the above description regarding the MP3 player is merely an example, and should not be considered as a uniquely possible implementation. Obviously, for those skilled in the art, after understanding the basic principles of the MP3 player, the specific ways and steps of the implementation of the MP3 player may be modified or changed without departing from the principle. For example, a number of annular ridge portion 71 and the annular connection part 72 may be not limited to the figure, and may be determined according to the actual use. Further, for example, the number of annular ridge portion 71 and the annular connection part 72 may be set according to a length of the protective sleeve 700, a width of the annular ridge portion 71 and the annular connection part 72 along the length of the protective sleeve 700. Such modifications are within the scope of the present disclosure.

Figure 18:
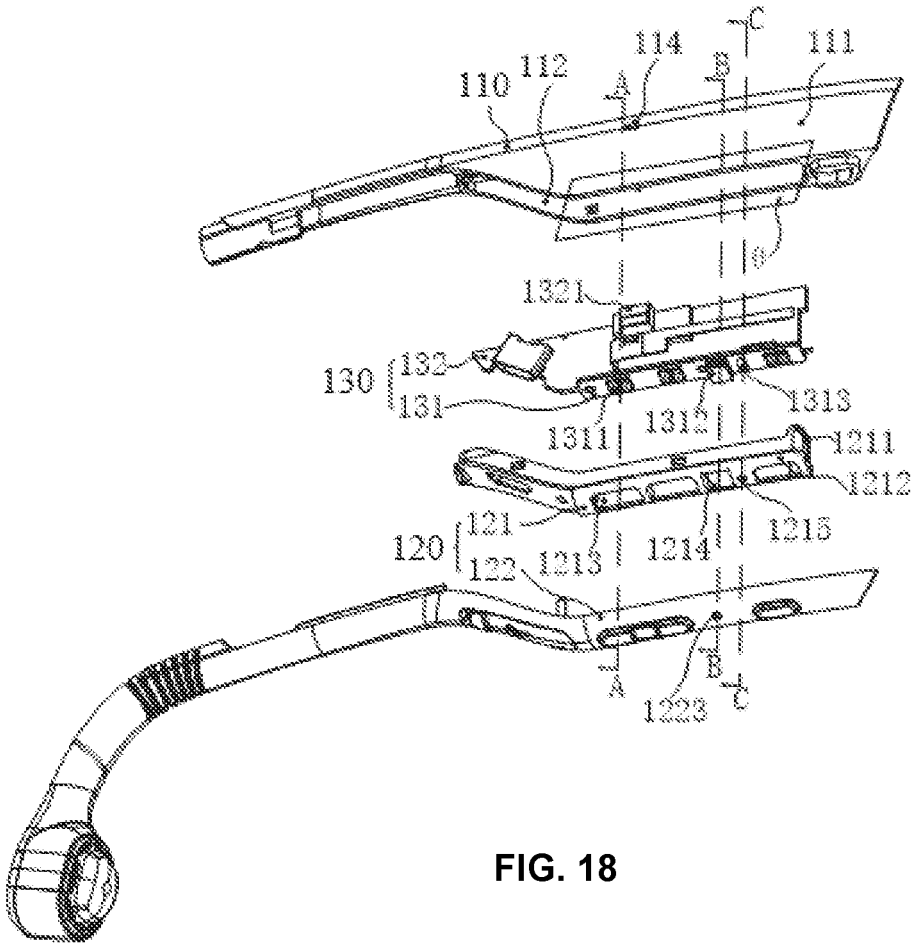
FIG. 18 is a schematic diagram illustrating an exploded structural view of an exemplary electronic component according to some embodiments of the present disclosure.
Figure 19:
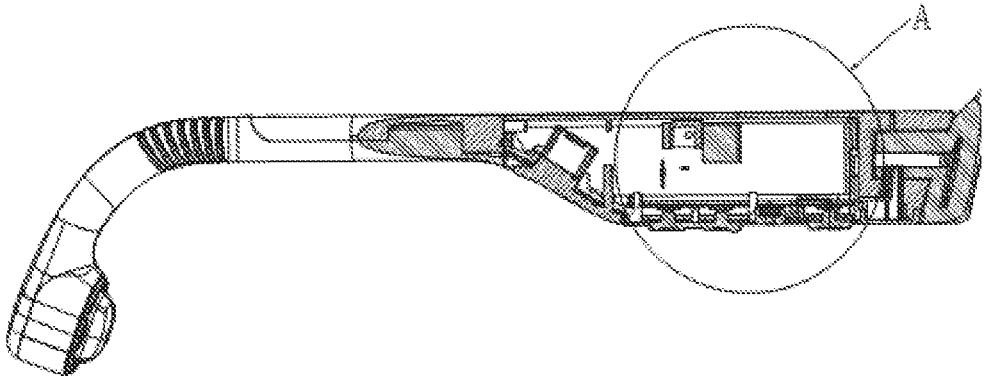
FIG. 19 is a schematic diagram illustrating a partial cross-sectional view of an exemplary electronic component according to some embodiments of the present disclosure.
Figure 20:
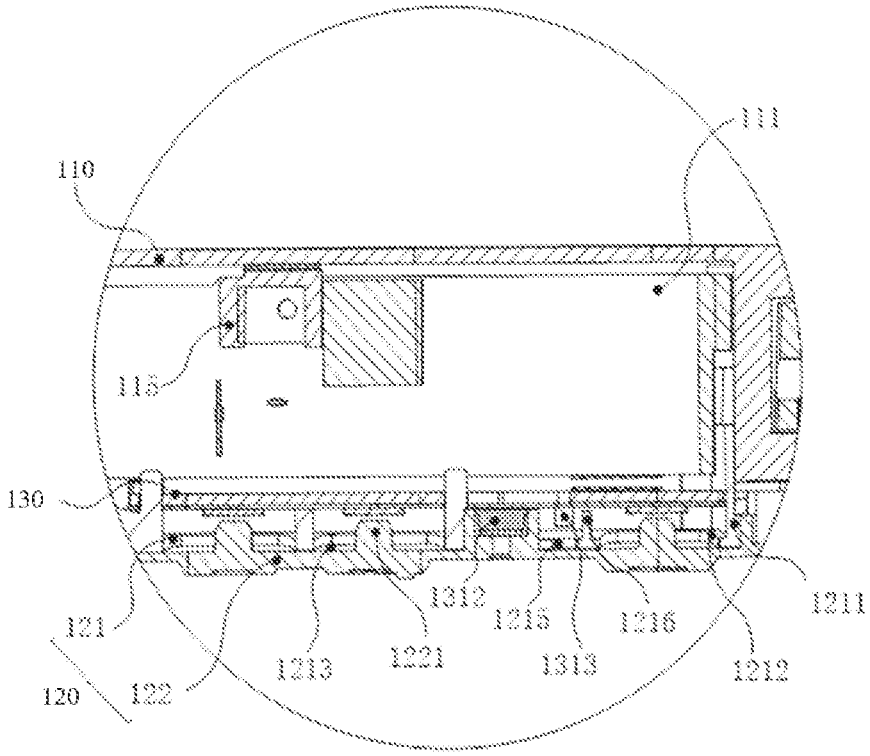
FIG. 20 is a schematic diagram illustrating an enlarged view of part A in FIG. 19 according to some embodiments of the present disclosure.

FIG. 18 is a schematic diagram illustrating an exploded structural view of an exemplary electronic component according to some embodiments of the present disclosure. FIG. 19 is a schematic diagram illustrating a partial cross-sectional view of an exemplary electronic component according to some embodiments of the present disclosure. FIG. 20 is a schematic diagram illustrating an enlarged view of part A in FIG. 19 according to some embodiments of the present disclosure. The electronic components in the present disclosure may be applied to an electronic device. The electronic device may be any electronic device that needs to seal the internal structure, such as the earphone, the MP3 player, the hearing aid, a mobile phone, a tablet computer, or glasses with a circuit component and an electronic device, or the like, or any combination thereof. In some embodiments, the electronic component may include the circuit housing 30 in FIG. 2 and its internal circuits. The electronic component may be also referred to as the circuit housing (e.g., the circuit housing 30).

Referring to FIG. 18, FIG. 19, and FIG. 20, in some embodiments, the electronic component (e.g., the circuit housing 30) may include a housing body 110 and a cover body 120. The housing body 110 may be disposed with a cavity 111 having at least one opening 112. The cover body 120 may be covered on the opening 112 of the cavity 111 and may be used to seal the cavity 111.

In some embodiments, the housing body 110 may be at least part of the electronic device. The housing body 110 may be a structure for holding other components such as a circuit board, a battery, and electronic components in an electronic device. For example, the housing body 110 may be the whole of the ear hook of the MP3 player or a part of the ear hook of the MP3 player. In some embodiments, the housing body 110 may be disposed with the cavity 111 having the opening 112 for containing the circuit board, battery, and electronic components.

The shape of the cover body 120 may at least partially match the shape of the opening 112. The cover body 120 may be placed on the opening 112 to seal the cavity 111. The material of the cover body 120 may be different from or partially the same as the material of the housing body 110. In some embodiments, the cover body 120 may include a hard support 121 and a soft cover layer 122. The support 121 may be used for physical connection with the housing body 110. The soft cover layer 122 may be integrally injection-moulded on the surface of the support 121 to provide a seal for the cavity 111 after the support 121 is connected to the housing body 110.

In some embodiments, the material of the support 121 may be a hard plastic. The material of the soft cover layer 122 may be the soft silicone or the rubber. The shape of the side of the support 121 facing the housing body 110 may match the shape of the opening 112. The support 121 may be fixed to the opening 112 of the cavity 111 by means of inserting, buckling, etc. The support 121 may be physically connected with the housing body 110. The hard support 121 may be easier to form a gap at the physical connection of the housing body 110 and reduce the sealing of the cavity 111. In some embodiments, the soft cover layer 122 may be integrally injection-moulded and formed on the outer surface of the support 121 away from the housing body 110. The soft cover layer 122 may further cover the connection between the support 121 and the housing body 110, thereby achieving the seal of the cavity 111.

In some embodiments, the cover body 120 may include the hard support 121 and the soft cover layer 122 integrally injection-moulded on the surface of the hard support 121. The support 121 may be physically connected to the housing body 110. The soft cover layer 122 may further provide a seal for the cavity 111 after the support 121 is connected to the housing body 110. The soft cover layer 122 may be more conducive to fit the gap between the support 121 and the housing body 110. The sealing performance of the electronic component and the waterproof effect of the electronic component may be improved. At the same time, the support 121 and the soft cover layer 122 may be integrally injection-moulded. The assembly process of electronic components may be simplified.

In some embodiments, the support 121 may include an insertion part 1211 and a cover part 1212. The cover part 1212 may be covered on the opening 112. The insertion part 1211 may be disposed on one side of the cover part 1212 and may extend into the cavity 111 along the inner wall of the cavity 111 to fix the cover part 1212 on the opening 112.

In some embodiments, the insertion part 1211 may not be inserted through the inner wall of the cavity 111. For example, the inside of the cavity 111 may further be disposed with a plug portion that matches the shape of the insertion part 1211 of the support 121. The insertion part 1211 may be engaged with the plug portion, and the plug portion may be fixed inside the cavity 111. For example, the shape of the insertion part 1211 may be a cylinder. The plug portion may be a cylindrical ring that can surround the cylindrical plug portion. The inner diameter of the plug portion of the cylindrical ring may be appropriately less than the outer diameter of the plug portion of the cylindrical body. When the insertion part 1211 is inserted into the plug portion, the interference fit with the plug portion may cause the support 121 to be stably connected to the cavity 111. In some embodiments, other insertion ways may also be used, as long as the insertion part 1211 may be inserted into the cavity 111 and fixed to the cavity 111.

The cover part 1212 may be disposed on a side of the insertion part 1211 facing away from the cavity 111, and may cover the opening 112 after the insertion part 1211 is inserted into the cavity 111. The cover part 1212 may be a complete structure, or may be further disposed with some holes according to needs, so as to achieve a certain function.

Figure 21:
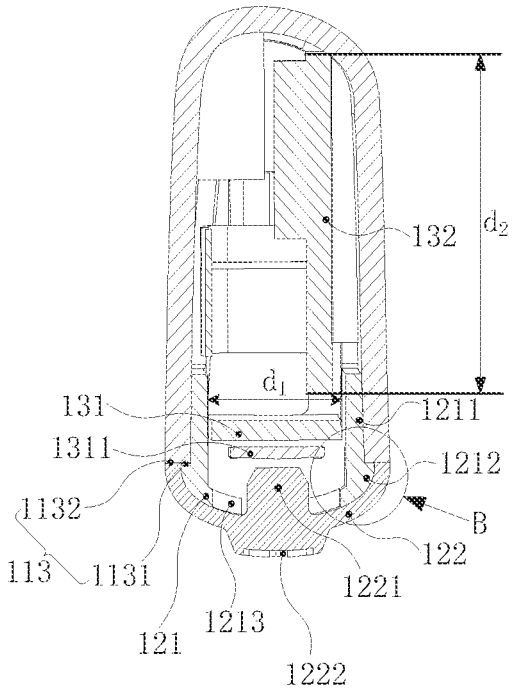
FIG. 21 is a schematic diagram illustrating a cross-sectional view of an electronic component under an assembled state along A-A axis illustrated in FIG. 18 according to some embodiments of the present disclosure.

FIG. 21 is a schematic diagram illustrating a cross-sectional view of an electronic component under an assembled state along A-A axis illustrated in FIG. 18 according to some embodiments of the present disclosure. As shown in FIG. 21, in some embodiments, the housing body 110 may include an opening edge 113 for defining the opening 112. The cover part 1212 may be pressed against the inner region 1131 of the opening edge 113 near the opening 112. The soft cover layer 122 may cover the outer surface of the cover part 1212 away from the housing body 110 and may be pressed on the outer region 1132 where is the periphery of the inner region 1131 of the opening edge 113, thereby achieving a seal between the soft cover layer 122 and opening edge 113.

The inner region 1131 and the outer region 1132 of the opening edge 113 may belong to the opening edge 113, rather than other regions except the opening edge 113. The inner region 1131 of the opening edge 113 may be a region of the opening edge 113 close to the opening 112. The outer region 1132 of the opening edge 113 may be a region of the opening edge 113 away from the opening 112.

In some embodiments, the cover part 1212 of the support 121 may be pressed against the inner region 1131 of the opening edge 113 near the opening 112. The cover part 1212 may initially seal the opening edge 113. Since the housing body 110 and the support 121 are both hard materials, the connection between the housing body 110 and the support 121 and the further covering of the cover part 1212 cannot achieve a good sealing effect. The cover part 1212 may be pressed against the opening edge 113. The end away from the opening 112 may be easy to generate a gap between the opening edge 113 and the gap and further penetrate through the cavity 111, thereby reducing the seal.

In some embodiments, the soft cover layer 122 may cover the outer surface of the cover part 1212 away from the housing body 110, and may be further pressed on the outer region 1132 on the periphery of the inner region 1131 of the opening edge 113. The gap generated between the cover part 1212 and the opening edge 113 of the support 121 may be further covered. Because the soft cover layer 122 is made of a soft material, the sealing effect of the electronic component may be improved and the electronic component may be waterproof.

Figure 22:
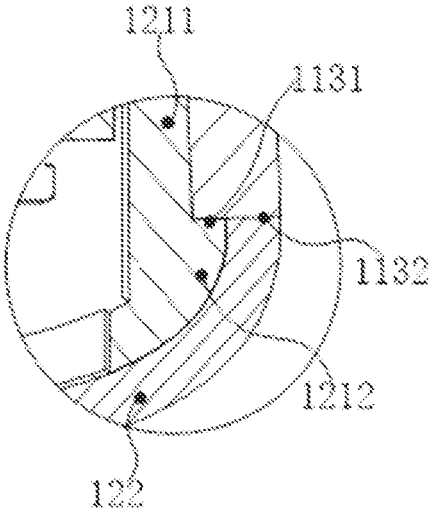
FIG. 22 is a schematic diagram illustrating an enlarged view of part B in FIG. 21 according to some embodiments of the present disclosure.

FIG. 22 is a schematic diagram illustrating an enlarged view of part B in FIG. 21 according to some embodiments of the present disclosure. As shown in FIG. 22, in some embodiments, when the cover body 120 is snapped, the periphery of the cover part 1212 may cover the inner region 1131 of the opening edge 113 and may be in contact with the inner region 1131 of the opening edge 113. The soft cover layer 122 may be disposed on a side of the cover part 1212 away from the housing body 110. The cover part 1212 of the inner region 1131 located inside the opening edge 113 may be sandwiched between the inner region 1131 of the opening edge 113 and the soft cover layer 122. The soft cover layer 122 may further extend along a direction in which the cover part 1212 is away from the opening 112 and in a direction toward the opening edge 113 until it contacts the outer region 1132 of the opening edge 113. The contact end surface of the cover part 1212 and the opening edge 113 and the contact end surface of the soft cover layer 122 and the opening edge 113 may be arranged flush with each other. An "opening edge 113—cover part 1212—soft coverer layer 122" structure may be formed on the inner region 1131 of the opening edge 113.

Figure 23:
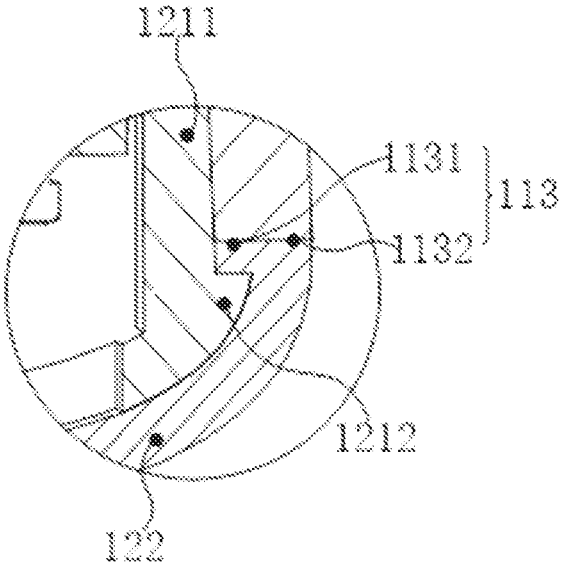
FIG. 23 is a schematic diagram illustrating a partial cross-sectional view of an exemplary electronic component according to some embodiments of the present disclosure.

FIG. 23 is a schematic diagram illustrating a partial cross-sectional view of an exemplary electronic component according to some embodiments of the present disclosure. As shown in FIG. 23, in some embodiments, after the soft cover layer 122 extends to the outer region 1132 of the opening edge 113 and contact with the outer region 1132, the region between the cover part 1212 and the opening edge 113 may further be extended to the inner region 1131 of the opening edge 113. The inner region 1131 of the opening edge 113 may be between the cover part 1212 and the cover part 1212 and may be pressed on the inner region 1131 of the opening edge 113 to form a structure of "opening edge 113—soft cover layer 122—cover part 1212—soft cover layer 122". In some embodiments, the soft cover layer 122 may further extend between the support 121 and the opening edge 113 on the basis of the cover part 1212 of the rigid support 121, thereby further improving the seal between the cavity 111 and the cover body 120, and further improving the waterproof effect of the electronic component.

Referring to FIG. 18 to FIG. 21, the electronic component may further include a circuit component 130 disposed in the cavity 111. The circuit component 130 may be disposed with a switch 1311. In some embodiments, the circuit component 130 may include a first circuit board 131 disposed on an outer side of the first circuit board 131 facing the opening 112 of the cavity 111. In some embodiments, the circuit components may correspond to the control circuit in FIG. 2.

Correspondingly, the support 121 may be disposed with a switch hole 1213 corresponding to the switch 1311. The soft cover layer 122 may further cover the switch hole 1213. A pressing part 1221 may be disposed at a position corresponding to the switch hole 1213. The pressing part 1221 may extend toward the inside of the cavity 111 through the switch hole 1213. When the corresponding position of the soft cover layer 122 is pressed, the pressing part 1221 may press the switch 1311 on the circuit component 130, thereby triggering the circuit component 13 to execute a preset function.

The pressing part 1221 disposed on the soft cover layer 122 may be formed by protruding the side of the soft cover layer 122 toward the support 121 toward the switch hole 1213 and the switch 1311. The shape of the pressing part 1221 may match the shape of the switch hole 1213. When the corresponding position of the soft cover layer 122 is pressed, the pressing part 1221 may pass through the switch hole 1213 to reach the corresponding switch 1311 on the first circuit board 131. At the same time, the length of the pressing part 1221 in the direction toward the switch 1311 may be determined so that the switch 1311 is not pressed when the position corresponding to the soft cover layer 122 is not pressed, and the corresponding switch 1311 may be pressed when the position corresponding to the soft cover layer 122 is pressed.

In some embodiments, a position on the soft cover layer 122 corresponding to the pressing part 1221 may further be protruded toward a side facing away from the support 121 to form a convex pressing part 1222. The user can clear the position of the switch 1311 may be clear for the user. By pressing the corresponding pressing part 1222, the starting circuit component 130 may be triggered to implement the corresponding functions.

Figure 24:
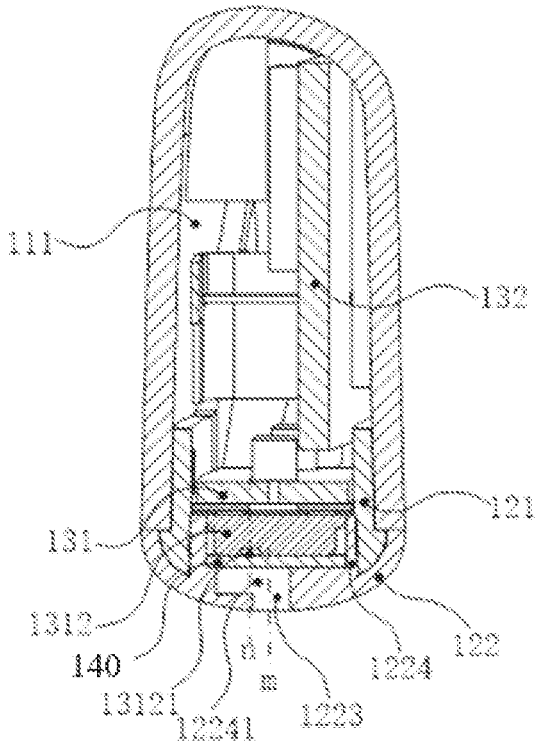
FIG. 24 is a schematic diagram illustrating a cross-sectional view of an exemplary electronic component under an assembled state along B-B axis in FIG. 18 according to some embodiments of the present disclosure.

FIG. 24 is a schematic diagram illustrating a cross-sectional view of an exemplary electronic component under an assembled state along B-B axis in FIG. 18 according to some embodiments of the present disclosure. As shown in FIG. 24, the electronic component may include a first microphone element 1312. In some embodiments, the first microphone element 1312 may be disposed on a first circuit board 131 of a circuit assembly 13, and may be accommodated in the cavity 111. For example, the first microphone element 1312 may be disposed on the first circuit board 131 at a distance from the switch 1311. The first microphone element 1312 may be configured to receive a sound signal from the outside of the electronic component, and convert the sound signal into an electrical signal for analyzing and processing.

In some embodiments, a microphone hole 1214 corresponding to the first microphone element 1312 may be disposed on the support 121. A first sounding hole 1223 corresponding to the microphone hole 1214 may be disposed on the soft cover layer 122. A first sound blocking component 1224 may be disposed at a position corresponding to the microphone hole 1214. The first sound blocking component 1224 may extend toward the inside of the cavity 111 through the microphone hole 1214 and define a sounding channel 12241. One end of the sounding channel 12241 may connect with the first sounding hole 1223 on the soft cover layer 122, and the first microphone element 1312 may be inserted into the sounding channel 12241 from the other end of the sounding channel 12241.

In some embodiments, when the electronic component includes the switch 1311, the switch hole 1213 and the microphone hole 1214 may be disposed on the support 121 at intervals.

In some embodiments, the first sounding hole 1223 may be disposed through the soft cover layer 122 and may correspond to the position of the first microphone element 1312. The first sounding hole 1223 may correspond to the microphone hole 1214 on the support 121, and may further connect the first microphone element 1312 with the outside of the electronic component. The sound outside the electronic component may be received by the first microphone element 1312 through the first sounding hole 1223 and the microphone hole 1214.

The shape of the first sounding hole 1223 may be various, as long as it can input sound from the outside of the electronic component. In some embodiments, the first sounding hole 1223 may be a circular hole with a relatively small size, and may be disposed in a region of the soft cover layer 122 corresponding to the microphone hole 1214. The first sounding hole 1223 with a relatively small size may reduce the connection between the first microphone element 1312 in the electronic component and the outside of the electronic component, thereby improving the sealing of the electronic component.

In some embodiments, the first sound blocking component 1224 may extend from the periphery of the first sounding hole 1223 through the microphone 12212 through the soft cover layer 122 to the inside of the cavity 111 to the periphery of the first microphone element 1312. A sounding channel 12241 from the first sounding hole 1223 to the first microphone element 1312 may be formed. The sound signal of the electronic component entering into the sound guide hole may directly reach the first microphone element 1312 through the sounding channel 12241.

In some embodiments, the shape of the sounding channel 12241 in a cross section perpendicular to the length direction may be the same as or different from the shape of the microphone hole 1214 or the first microphone element 1312. In some embodiments, the cross-sectional shapes of the microphone hole 1214 and the first microphone element 1312 in a direction perpendicular to the support 121 toward the cavity 111 may be square. The size of the microphone hole 1214 may be slightly larger than the periphery size of the sounding channel 12241. The internal size of the sounding channel 12241 may be not less than the periphery size of the first microphone element 1312. The sounding channel 12241 may pass through the first sounding hole 1223 to reach the first microphone element 1312 and wrap around the periphery of the first microphone element 1312.

In this case, the soft cover layer 122 of the electronic component may be disposed with a first sounding hole 1223 and a sounding channel 12241 surrounded by the periphery of the first sounding hole 1223 through the microphone hole 1214 to reach the first microphone element 1312 and wrapping around the periphery of the first microphone element 1312. The sounding channel 12241 may be disposed so that the sound signal entering through the first sounding hole 1223 can reach the first microphone element 1312 through the first sounding hole 1223 and be received by the first microphone element 1312. The leakage of sound signals in the propagation process may be reduced, thereby improving the efficiency of receiving electronic signals by electronic components.

In some embodiments, the electronic component may also include a waterproof mesh cloth 140 disposed in the sounding channel 12241. The waterproof mesh cloth 140 may be held against the side of the soft cover layer 122 facing the microphone element by the first microphone element 1312 and cover the first sounding hole 1223.

In some embodiments, the support 121 in a position close to the first microphone element 1312 in the sounding channel 12241 may be convex to form a convex surface opposite to the first microphone element 1312. The waterproof mesh cloth 140 may be sandwiched between the first microphone element 1312 and the convex surface, or may be directly bonded to the periphery of the first microphone element 1312, and the specific setting manner is not limited herein.

In addition to the waterproof effect of the first microphone element 1312, the waterproof mesh cloth 140 may also entrant sound to avoid adversely affecting the sound receiving effect of a sound receiving area 13121 of the first microphone element 1312.

In some embodiments, the cover body 120 may be arranged in a strip shape. A main axis of the first sounding hole 1223 and a main axis of the sound receiving area 13121 of the first microphone element 1312 may be spaced from each other in a width direction of the cover body 120. The main axis of the sound receiving area 13121 of the first microphone element 1312 may refer to the main axis of the sound receiving area 13121 of the first microphone element 1312 in the width direction of the cover body 120, such as the axis n illustrated in FIG. 24. The main axis of the first sounding hole 1223 may be the axis m illustrated in FIG. 24.

It should be noted that the first microphone element 1312 may be disposed at a first position of the first circuit board 131. When the first sounding hole 1223 is disposed, the first sounding hole 1223 may be disposed at the second position of the cover body 120 due to the requirements of beauty and convenience. In some embodiments, the first position and the second position may not correspond in the width direction of the cover body 120, so that the main axis of the first sounding hole 1223 and the main axis of the sound receiving area 13121 of the first microphone element 1312 are spaced from each other in the width direction of the cover body 120. The sound input through the first sounding hole 1223 may not reach the sound receiving area 13121 of the first microphone element 1312 along a straight line.

In some embodiments, in order to guide the sound signal entered by the first sounding hole 1223 to the first microphone element 1312, the sounding channel 12241 may be curved.

In some embodiments, the main axis of the first sounding hole 1223 may be disposed in the middle of the cover body 120 in the width direction of the cover body 120.

In some embodiments, the cover body 120 may be a part of the outer housing of the electronic device. In order to meet the overall aesthetic requirements of the electronic device, the first sounding hole 1223 may be disposed in the middle of the width direction of the cover body 120. The first sounding hole 1223 may be symmetrical and meets people's visual needs.

In some embodiments, the corresponding sounding channel 12241 may have a stepped shape along the cross section along B-B axis illustrated in FIG. 18. The sound signal introduced by the first sounding hole 1223 may be transmitted to the first microphone element 1312 through the stepped sounding channel 12241 and may be received by the first microphone element 1312.

Figure 25:
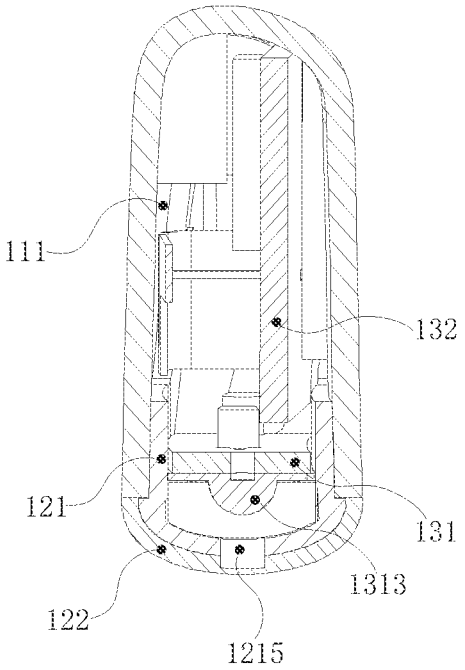
FIG. 25 is a schematic diagram illustrating a cross-sectional view of an exemplary electronic component under a combined state along C-C axis in FIG. 18 according to some embodiments of the present disclosure.

FIG. 25 is a schematic diagram illustrating a cross-sectional view of an exemplary electronic component under a combined state along C-C axis in FIG. 18 according to some embodiments of the present disclosure. As shown in FIG. 25, in some embodiments, the electronic component may include a light emitting element 1313. The light emitting element 1313 may be disposed on the first circuit board 131 of the circuit component 130 and may be accommodated in the cavity 111. For example, the light emitting element 1313, the switch 1311, and the first microphone element 1312 may be disposed on the first circuit board 131 in a certain arrangement.

In some embodiments, the support 121 may be disposed with a light emitting hole 1215 corresponding to the light emitting element 1313, and the soft cover layer 122 may cover the light emitting hole 1215. A thickness of a region of the soft cover layer 122 corresponding to the light emitting hole 1215 may allow light generated by the light emitting element 1313 to be transmitted through the soft cover layer 122.

In some embodiments, the soft cover layer 122 may transmit the light emitted from the light emitting element 1313 to the outside of the electronic component under a condition that the soft cover layer 122 covers the light emitting hole 1215 in a certain manner.

In some embodiments, a thickness of the entire region or a portion of the region of the soft cover layer 122 corresponding to the light emitting hole 1215 may be less than a thickness of a region corresponding to the periphery of the light emitting hole 1215. The light emitted by the light emitting element 1313 may pass through the light emitting hole 1215 and be transmitted through the soft cover layer 122. The region of the light emitting hole 1215 covered by the soft cover layer 122 may transmit light in other manners, which is not limited herein.

In some embodiments, the soft cover layer 122 may be configured to cover the light emitting hole 1215 corresponding to the light emitting element 1313. The light emitted by the light emitting element 1313 may be transmitted from the soft cover layer 122 to the outside of the electronic component. Thus, the light emitting element 1313 may be sealed by the soft cover layer 122 without affecting the light-emitting function of the electronic component, thereby improving the sealing and waterproof performance of the electronic component.

It should be noted that the description of the MP3 player described above is merely for illustration purposes and should be not regarded as the only feasible implementation solution. Obviously, for those skilled in the art, after understanding the basic principle of the MP3 player, it may be possible to make various modifications and changes in forms and details of the specific methods and operations of implementing the MP3 player without departing from the principles. However, these modifications and changes are still within the scope of the present disclosure. For example, a number of openings 112 may be one or more, which are not limited here. For example, in some embodiments, a number of switches 1311 may be one or more. When the number of switches 1311 is plural, they may be spaced on the first circuit board 131. Since this type of deformation is within the scope of the present disclosure. Such modifications are within the scope of the present disclosure.

Figure 26:
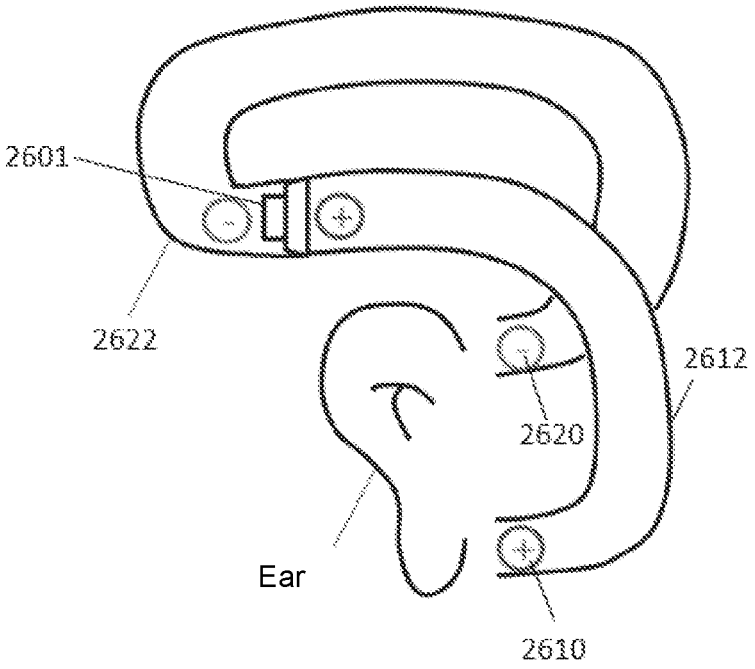
FIG. 26 is a schematic diagram illustrating transmitting sound through air conduction according to some embodiments of the present disclosure.

In some embodiments, the speaker device (e.g., the MP3 player) described above may transmit the sound to the user through air conduction. When the air condition is used to transmit the sound, the speaker device may include one or more sound sources. The sound source may be located at a specific position of the user's head, for example, the top of the head, a forehead, a cheek, a temple, an auricle, the back of an auricle, etc., without blocking or covering an ear canal. FIG. 26 is a schematic diagram illustrating transmitting sound through air conduction according to some embodiments of the present disclosure.

As shown in FIG. 26, a sound source 2610 and a sound source 2620 may generate sound waves with opposite phases ("+" and "−" in the figure may indicate the opposite phases). For brevity, the sound sources used herein may refer to sound outlets of a speaker device that outputs sounds. For example, the sound source 2610 and the sound source 2620 may be two sound outlets respectively located at a specific position (e.g., the core housing 20 or the circuit housing 30) of the speaker device.

In some embodiments, the sound source 2610 and the sound source 2620 may be generated by a same vibration device 2601. The vibration device 2601 may include a diaphragm (not shown in FIG. 28). When the diaphragm is driven to vibrate by an electric signal, a front side of the diaphragm may drive air to vibrate. The sound source 2610 may be formed at a sound output hole through a sound guiding channel 2612. A back side of the diaphragm may drive air to vibrate, and the sound source 2620 may be formed at the sound output hole through a sound guiding channel 2622. The sound guiding channel refers to a sound transmission route from the diaphragm to the corresponding outlet. In some embodiments, the sound guiding channel may be a route surrounded by a specific structure (e.g., the core housing 20 or the circuit housing 30) on the speaker device. It should be noted that in some alternative embodiments, the sound source 2610 and the sound source 2620 may be generated by different vibrating diaphragms of different vibration devices, respectively.

Among the sounds generated by the sound source 2610 and the sound source 2620, one portion of the sounds may be transmitted to the ear of a user to form a sound heard by the user. Another portion of the sound may be transmitted to the environment to form a leaked sound. Considering that the sound source 2610 and the sound source 2620 are relatively close to the ears of the user, for convenience of description, the sound transmitted to the ear of the user may be referred to as a near-field sound. The leaked sound transmitted to the environment may be referred to as a far-field sound. In some embodiments, the near-field/far-field sounds with different frequencies generated by the speaker device may be related to a distance between the sound source 2610 and the sound source 2620. Generally, the near-field sound generated by the speaker device may increase along with an increment of the distance between the two sound sources, and the far field sound (i.e., the leaked sound) may increase along with an increment of a frequency.

For sounds with different frequencies, the distance between the sound source 2610 and the sound source 2620 may be designed, respectively, so that a low-frequency near-field sound (e.g., a sound with a frequency less than 800 Hz) generated by the speaker device may be relatively great, and a far-field sound with the relatively high frequency (e.g., a sound with a frequency greater than 2000 Hz) may be relatively small. In order to implement the above purpose, the speaker device may include two or more sets of dual sound sources. Each set of the dual sound sources may include two sound sources similar to the sound source 2610 and the sound source 2620, and generate sounds with a specific frequency, respectively. Specifically, a first set of the dual sound sources may be used to generate a sound with a relatively low frequency. A second set of the dual sound sources may be used to generate a sound with a relatively great frequency. To increase a volume of the near-field sound with the relatively low frequency, the distance between two sound sources in the first set of the dual sound sources may be set with a relatively large value. Since the low-frequency near-field sound may have a relatively long wavelength, the relatively great distance between the two sound sources may not cause a relatively great phase difference in the far-field, and thereby reducing sound leakage in the far-field. In some embodiments, to reduce the far-field sound with the relatively high frequency, the distance between the two sound sources in the second set of the dual sound sources may be set with a relatively small value. Since the far field sound with the relatively high frequency may have a relatively short wavelength, the relatively small distance between the two sound sources may avoid the generation of a relatively large phase difference in the far-field, thereby reducing the sound leakage. The distance between the two sound sources of the second set of the dual sound sources may be less than the distance between the two sound sources of the first set of the dual sound sources.

The beneficial effects of the embodiments of the present disclosure may include but are not limited to the following. (1) Waterproof performance of a speaker device may be improved through sealed connections between various components of the speaker device in this present disclosure; (2) An elastic pad covering outside of a button hole may prevent the external liquid from entering into a circuit housing through the button hole, thereby improving the sealing and waterproof performance of a button mechanism of the speaker device; (3) The core housing and the ear hook of the speaker device may be connected through a hinge component, and the fitting position of the core housing of the earphone core and the human skin may be adjusted; (4) The soft cover layer and the support may be sealed to improve the waterproof performance of the electronic components. It should be noted that different embodiments may have different beneficial effects. In different embodiments, the possible beneficial effects may be any one or a combination of the beneficial effects described above, or any other beneficial effects.

The basic concepts have been described above. Obviously, to those skilled in the art, the disclosure of the invention is merely by way of example, and does not constitute a limitation on the present disclosure. Although not explicitly stated here, those skilled in the art may make various modifications, improvements, and amendments to the present disclosure. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure, or characteristic described in connection with the embodiment in connection with at least one embodiment of the present disclosure. Therefore, it is emphasized and should be appreciated that two or more references to "an embodiment" or "one embodiment" or "an alternative embodiment" in various parts of this specification are not necessarily all referring to the same embodiment. Furthermore, some features, structures, or features in the present disclosure of one or more embodiments may be appropriately combined.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module," or "system." Furthermore, aspects of the present disclosure may take the form of a computer program product embodied in one or more computer-readable media having computer readable program code embodied thereon.

Furthermore, the recited order of processing elements or sequences, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. However, this disclosure method does not mean that the present disclosure object requires more features than the features mentioned in the claims. Rather, claimed subject matter may lie in less than all features of a single foregoing disclosed embodiment.

In some embodiments, the numbers expressing quantities of ingredients, properties, and so forth, used to describe and claim certain embodiments of the application are to be understood as being modified in some instances by the term "about," "approximate," or "substantially" and etc. Unless otherwise stated, "about," "approximate," or "substantially" may indicate ±20% variation of the value it describes. Accordingly, in some embodiments, the numerical parameters set forth in the description and attached claims are approximations that may vary depending upon the desired properties sought to be obtained by a particular embodiment. In some embodiments, numerical data should consider the specified significant digits and use a method reserved for general digits. Notwithstanding that the numerical ranges and parameters configured to illustrate the broad scope of some embodiments of the present disclosure are approximations, the numerical values in specific examples may be as accurate as possible within a practical scope.

At last, it should be understood that the embodiments described in the present application are merely illustrative of the principles of the embodiments of the present application. Other modifications that may be employed may be within the scope of the application. Thus, by way of example, but not of limitation, alternative configurations of the embodiments of the application may be utilized in accordance with the teachings herein. Accordingly, embodiments of the present disclosure are not limited to the embodiments that are expressly introduced and described herein.

We claim:

1. A speaker device, comprising:

a circuit housing configured to accommodate a control circuit or a battery;

an ear hook, one end of the ear hook being connected to the circuit housing;

a core housing configured to accommodate an earphone core, the control circuit or the battery driving the earphone core to vibrate to generate sound; the core housing being connected to an end of the ear hook far from the circuit housing through a hinge component, and the hinge component being able to rotate to change a location of the core housing relative to the ear hook, so as to make the core housing attach to a front or a back of a user's ear;

a button disposed at a button hole on the circuit housing, the button moving relative to the button hole to generate a control signal for the control circuit;

an elastic pad disposed between the button and the button hole, the elastic pad hindering a movement of the button toward the button hole; and a housing sheath is moulded on the ear hook, and the housing sheath is wrapped around a periphery of the circuit housing and a periphery of the button in a sleeved manner.

2. The speaker device of claim 1, wherein the circuit housing includes a main sidewall and an auxiliary sidewall connected to the main sidewall, a first recessed area is disposed on the auxiliary sidewall, the elastic pad being disposed in the first recessed area, and the elastic pad includes a second recessed area corresponding to the button hole, the second recessed area extending to an inside of the button hole.

3. The speaker device of claim 2, wherein the button includes a button body and a button contact, the button contact extends into the second recessed area, and the button body is disposed on a side of the button contact away from the elastic pad.

4. The speaker device of claim 3, wherein the circuit housing accommodates a button circuit board, a button switch corresponding to the button hole is disposed on the button circuit board, and the button contact is configured to contact with and trigger the button switch when a user presses the button.

5. The speaker device of claim 3, wherein the button includes at least two button units disposed apart from each other and a connection part configured to connect the at least two button units, and the elastic pad includes an elastic convex configured to support the connection part.

6. The speaker device of claim 1, wherein the housing sheath includes a bag-like structure with an open end; and the circuit housing and the button enter into the housing sheath through the open end of the housing sheath.

7. The speaker device of claim 6, wherein the open end of the housing sheath includes an annular flange protruding inwardly, an end of the circuit housing away from the ear hook has a stepped structure to form an annular table, and the annular flange abuts on the annular table when the housing sheath covers the periphery of the circuit housing.

8. The speaker device of claim 7, wherein a sealant is applied to a joint area between the annular flange and the annular table to connect the housing sheath and the circuit housing in a sealed manner.

9. The speaker device of claim 8, wherein at least one mounting hole is disposed on the circuit housing, the speaker device further includes at least one conductive post each of which is inserted into one mounting hole of the at least one mounting hole;

a hollow region is disposed on the board, the board is disposed on an inner surface of the circuit housing, and the at least one mounting hole is disposed inside the hollow region to form a glue tank on a periphery of the at least one conductive post.

10. The speaker device of claim 9, wherein the hollow region includes a notch, a striped convex rib corresponding to the notch is integrally formed on an inner surface of the main sidewall, and the striped convex rib cooperates with the auxiliary film to make the glue tank closed.

11. The speaker device of claim 1, wherein the hinge component comprises a hinge, a rod-like component, and a fixing component; the hinge includes:

a hinge base; and a hinge arm, wherein the hinge arm and the hinge base are rotatably connected by a rotating axis, and the hinge arm rotates relative to the hinge base under an external force, so to alter a position of the core housing relative to the ear hook.

12. The speaker device according to claim 1, wherein the core housing comprises a main housing and a partition assembly, the partition assembly is located inside the main housing and is connected to the main housing, and the partition assembly separates an inner space of the main housing into a first housing space and a second housing space;

the core housing is also provided with a plug hole that is connected to an outer end surface of the core housing.

13. The speaker device of claim 12, wherein the second housing space is disposed close to the plug hole.

14. The speaker device of claim 1, wherein the circuit housing comprises:

a housing body, which is provided with a cavity having at least one opening; and a cover, which is disposed on the opening for sealing the cavity;

wherein the cover includes a rigid support and a soft cover layer that is injection-moulded integrally on a surface of the support, the support is used to physically connect the housing body, and the cover layer is used to seal the cavity after the support is connected to the housing body.

15. The speaker device of claim 14, wherein a shape of a side of the support facing toward the housing body matches the opening so as to snap onto the opening, and the cover layer covers an outer surface of the support away from the housing body.

16. The speaker device of claim 15, wherein the support includes an insertion part and a cover part, the cover part is covered on the opening, the insertion part is disposed on one side of the cover part and extends into the cavity along an inner wall of the cavity to fix the cover part on the opening.

17. The speaker device of claim 16, wherein the housing body includes an opening edge for defining the opening, the cover part is pressed against an inner region of the opening edge near the opening, the cover layer covers an outer surface of the cover part away from the housing body, and is pressed on an outer region outside the inner region of the opening edge, thereby achieving a seal between the cover layer and the opening edge.

18. The speaker device according to claim 17, wherein in a snapped state, a contact end surface between the cover part and the opening edge is flush with a contact end surface between the cover layer and the opening edge, or the cover layer further extends between the cover part and the opening edge, and is pressed on the inner region of the opening edge by the cover part.

19. The speaker apparatus according to claim 15, wherein a cavity of the housing body includes a circuit component, the circuit component including a switch; the support includes a switch hole corresponding to the switch, the cover layer covering the switch hole and including a pressing part at a position corresponding to the switch hole, the pressing part extending toward the inside of the cavity through the switch hole;

when a corresponding position of the cover layer is pressed, the pressing part pressing the switch on the circuit component, thereby triggering the circuit component to perform a preset function.

* * * * *